US008801541B2

(12) United States Patent
Beach et al.

(10) Patent No.: US 8,801,541 B2
(45) **Date of Patent: *Aug. 12, 2014**

(54) GOLF CLUB

(75) Inventors: Todd P. Beach, San Diego, CA (US); Joseph Henry Hoffman, Carlsbad, CA (US); Drew T. DeShiell, Oceanside, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 455 days.

This patent is subject to a terminal disclaimer.

(21) Appl. No.: 12/813,442

(22) Filed: Jun. 10, 2010

(65) Prior Publication Data

US 2010/0273572 A1 Oct. 28, 2010

Related U.S. Application Data

(63) Continuation-in-part of application No. 12/006,060, filed on Dec. 28, 2007, which is a continuation-in-part of application No. 11/863,198, filed on Sep. 27, 2007, now Pat. No. 7,731,603.

(51) Int. Cl.
*A63B 53/04* (2006.01)

(52) U.S. Cl.
USPC ..... 473/345; 473/282; 473/298; 473/304

(58) Field of Classification Search
USPC ..... 473/324–350
See application file for complete search history.

(56) References Cited

U.S. PATENT DOCUMENTS

| | | | |
|---|---|---|---|
| 1,518,316 | A | 12/1924 | Ellingham |
| 1,526,438 | A | 2/1925 | Scott |
| 1,538,312 | A | 5/1925 | Beat |
| 1,592,463 | A | 7/1926 | Marker |
| 1,658,581 | A | 2/1928 | Tobia |
| 1,704,119 | A | 3/1929 | Buhrke |
| 1,970,409 | A | 8/1934 | Wiedemann |
| D107,007 | S | 11/1937 | Cashmore |
| 2,214,356 | A | 9/1940 | Wettlaufer |
| 2,225,930 | A | 12/1940 | Sexton |

(Continued)

FOREIGN PATENT DOCUMENTS

| | | |
|---|---|---|
| DE | 9012884 | 9/1990 |
| EP | 0982052 A1 | 3/2000 |

(Continued)

OTHER PUBLICATIONS

Final Office action from the U.S. Patent and Trademark Office in U.S. Appl. No. 12/775,359, dated Aug. 19, 2011.

(Continued)

*Primary Examiner* — Alvin Hunter
(74) *Attorney, Agent, or Firm* — Klarquist Sparkman, LLP

(57) ABSTRACT

A golf club head includes a body defining an interior cavity. The body includes a sole positioned at a bottom portion of the golf club head, a crown positioned at a top portion, and a skirt positioned around a periphery between the sole and crown. The body has a forward portion and a rearward portion. The club head includes a face positioned at the forward portion of the body. The face defines a striking surface having an ideal impact location at a golf club head origin. Some embodiments of the club head have a high moment of inertia and variable thickness face.

17 Claims, 13 Drawing Sheets

(56) References Cited

U.S. PATENT DOCUMENTS 2,360,364 A 10/1944 Reach
2,460,435 A 2/1949 Schaffer
2,681,523 A 6/1954 Sellers
3,064,980 A 11/1962 Steiner
3,466,047 A 9/1969 Rodia et al.
3,486,755 A 12/1969 Hodge
3,556,533 A 1/1971 Hollis
3,589,731 A 6/1971 Chancellor
3,606,327 A 9/1971 Gorman
3,610,630 A 10/1971 Glover
3,652,094 A 3/1972 Glover
3,672,419 A 6/1972 Fischer
3,692,306 A 9/1972 Glover
3,743,297 A 7/1973 Dennis
3,897,066 A 7/1975 Belmont
3,976,299 A 8/1976 Lawrence et al.
3,979,122 A 9/1976 Belmont
3,979,123 A 9/1976 Belmont
3,984,103 A * 10/1976 Nix ..... 473/291
4,008,896 A 2/1977 Gordos
4,043,563 A 8/1977 Churchward
4,052,075 A 10/1977 Daly
4,076,254 A 2/1978 Nygren
4,085,934 A 4/1978 Churchward
4,121,832 A 10/1978 Ebbing
4,165,874 A * 8/1979 Lezatte et al. ..... 473/291
4,214,754 A 7/1980 Zebelean
4,240,631 A * 12/1980 MacDougall ..... 473/289
4,261,566 A * 4/1981 MacDougall ..... 473/289
4,262,562 A 4/1981 MacNeill
D259,698 S 6/1981 MacNeill
4,340,229 A 7/1982 Stuff, Jr.
4,411,430 A 10/1983 Dian
4,423,874 A 1/1984 Stuff, Jr.
4,432,549 A 2/1984 Zebelean
4,438,931 A 3/1984 Motomiya
4,530,505 A 7/1985 Stuff
D284,346 S 6/1986 Masters
4,602,787 A 7/1986 Sugioka et al.
4,607,846 A 8/1986 Perkins
4,679,791 A * 7/1987 Hull ..... 473/201
4,712,798 A 12/1987 Preato
4,730,830 A 3/1988 Tilley
4,736,093 A 4/1988 Braly
4,754,977 A 7/1988 Sahm
4,795,159 A 1/1989 Nagamoto
4,819,939 A * 4/1989 Kobayashi ..... 473/299
4,867,457 A 9/1989 Lowe
4,867,458 A 9/1989 Sumikawa et al.
4,869,507 A 9/1989 Sahm
4,895,371 A 1/1990 Bushner
4,957,294 A 9/1990 Long
4,962,932 A 10/1990 Anderson
4,994,515 A 2/1991 Washiyama et al.
5,039,267 A 8/1991 Wollar
5,050,879 A 9/1991 Sun et al.
5,058,895 A 10/1991 Igarashi
RE33,735 E * 11/1991 Rumble et al. ..... 473/323
5,244,210 A 9/1993 Au
5,253,869 A 10/1993 Dingle et al.
D343,558 S 1/1994 Latraverse et al.
5,316,305 A 5/1994 McCabe
5,320,005 A 6/1994 Hsiao
5,328,176 A 7/1994 Lo
5,385,348 A 1/1995 Wargo
5,410,798 A 5/1995 Lo
5,421,577 A 6/1995 Kobayashi
5,429,365 A 7/1995 McKeighen
5,439,222 A 8/1995 Kranenberg
5,441,274 A 8/1995 Clay
5,447,309 A 9/1995 Vincent
D365,615 S 12/1995 Shimatani
5,482,280 A * 1/1996 Yamawaki ..... 473/290
5,518,243 A 5/1996 Redman
5,533,730 A 7/1996 Ruvang
5,571,053 A 11/1996 Lane
5,620,379 A 4/1997 Borys
5,624,331 A 4/1997 Lo et al.
5,629,475 A 5/1997 Chastonay
5,632,694 A 5/1997 Lee
5,669,827 A 9/1997 Nagamoto
5,683,309 A 11/1997 Reimers
5,709,613 A 1/1998 Sheraw
5,718,641 A 2/1998 Lin
D392,526 S 3/1998 Nicely
5,746,664 A 5/1998 Reynolds, Jr.
5,755,627 A 5/1998 Yamazaki et al.
5,769,737 A 6/1998 Holladay et al.
5,776,011 A 7/1998 Su et al.
RE35,955 E 11/1998 Lu
5,873,791 A 2/1999 Allen
D409,463 S 5/1999 McMullin
5,908,356 A * 6/1999 Nagamoto ..... 473/224
5,911,638 A 6/1999 Parente et al.
D412,547 S 8/1999 Fong
5,935,019 A 8/1999 Yamamoto
5,941,782 A 8/1999 Cook
5,947,840 A 9/1999 Ryan
5,954,596 A 9/1999 Noble et al.
5,967,905 A 10/1999 Nakahara et al.
5,997,415 A 12/1999 Wood
6,015,354 A 1/2000 Ahn et al.
6,019,686 A 2/2000 Gray
6,023,891 A 2/2000 Robertson et al.
6,032,677 A 3/2000 Blechman et al.
6,056,649 A 5/2000 Imai
6,089,994 A 7/2000 Sun
6,149,533 A 11/2000 Finn
6,162,133 A 12/2000 Peterson
6,238,303 B1 5/2001 Fite
6,244,974 B1 6/2001 Hanberry, Jr.
6,270,422 B1 8/2001 Fisher
6,277,032 B1 8/2001 Smith
6,296,579 B1 10/2001 Robinson
6,299,547 B1 10/2001 Kosmatka
6,332,848 B1 12/2001 Long et al.
6,334,817 B1 1/2002 Ezawa et al.
6,338,683 B1 1/2002 Kosmatka
6,348,014 B1 2/2002 Chiu
6,354,962 B1 3/2002 Galloway et al.
6,379,265 B1 4/2002 Hirakawa et al.
6,383,090 B1 5/2002 O'Doherty et al.
6,390,933 B1 5/2002 Galloway
6,398,666 B1 6/2002 Evans et al.
6,409,612 B1 6/2002 Evans et al.
6,425,832 B2 7/2002 Cackett et al.
6,428,425 B1 8/2002 Naruo et al.
6,436,142 B1 8/2002 Paes et al.
6,440,009 B1 8/2002 Guibaud et al.
6,471,604 B2 10/2002 Hocknell et al.
6,491,592 B2 12/2002 Cackett et al.
6,514,154 B1 2/2003 Finn
6,524,197 B2 2/2003 Boone
6,527,649 B1 3/2003 Neher et al.
6,530,848 B2 3/2003 Gillig
6,547,676 B2 4/2003 Cackett et al.
6,565,448 B2 5/2003 Cameron et al.
6,565,452 B2 5/2003 Helmstetter et al.
6,569,040 B2 5/2003 Bradstock
6,572,489 B2 6/2003 Miyamoto et al.
6,575,845 B2 6/2003 Galloway et al.
6,582,323 B2 6/2003 Soracco et al.
6,602,149 B1 8/2003 Jacobson
6,605,007 B1 8/2003 Bissonnette et al.
6,607,452 B2 8/2003 Helmstetter et al.
6,612,938 B2 9/2003 Murphy et al.
6,641,487 B1 11/2003 Hamburger
6,648,773 B1 11/2003 Evans
6,669,571 B1 12/2003 Cameron et al.
6,669,578 B1 12/2003 Evans
6,669,580 B1 12/2003 Cackett et al.
6,676,536 B1 1/2004 Jacobson
6,739,982 B2 5/2004 Murphy et al.
6,739,983 B2 5/2004 Helmstetter et al.

(56) References Cited

U.S. PATENT DOCUMENTS

| | | | | |
|---|---|---|---|---|
| 6,743,118 | B1 | 6/2004 | Soracco | |
| 6,757,572 | B1 | 6/2004 | Forest | |
| 6,758,763 | B2 | 7/2004 | Murphy et al. | |
| 6,773,360 | B2 | 8/2004 | Willett et al. | |
| 6,800,038 | B2 | 10/2004 | Willett et al. | |
| 6,824,475 | B2 | 11/2004 | Burnett et al. | |
| 6,860,818 | B2 | 3/2005 | Mahaffey et al. | |
| 6,860,823 | B2 | 3/2005 | Lee | |
| 6,860,824 | B2 | 3/2005 | Evans | |
| 6,875,129 | B2 | 4/2005 | Erickson et al. | |
| 6,878,073 | B2 * | 4/2005 | Takeda | 473/346 |
| 6,881,159 | B2 | 4/2005 | Galloway et al. | |
| 6,904,663 | B2 | 6/2005 | Willett et al. | |
| 6,926,619 | B2 | 8/2005 | Helmstetter et al. | |
| 6,960,142 | B2 | 11/2005 | Bissonnette et al. | |
| 6,964,617 | B2 | 11/2005 | Williams | |
| 6,974,393 | B2 * | 12/2005 | Caldwell et al. | 473/324 |
| 6,979,270 | B1 * | 12/2005 | Allen | 473/290 |
| 6,988,960 | B2 | 1/2006 | Mahaffey et al. | |
| 6,991,558 | B2 | 1/2006 | Beach et al. | |
| 6,997,820 | B2 | 2/2006 | Willett et al. | |
| 7,004,852 | B2 | 2/2006 | Billings | |
| 7,025,692 | B2 | 4/2006 | Erickson et al. | |
| 7,029,403 | B2 | 4/2006 | Rice et al. | |
| 7,056,228 | B2 * | 6/2006 | Beach et al. | 473/345 |
| 7,140,974 | B2 | 11/2006 | Chao et al. | |
| 7,153,220 | B2 | 12/2006 | Lo | |
| 7,163,468 | B2 | 1/2007 | Gibbs et al. | |
| 7,166,040 | B2 | 1/2007 | Hoffman et al. | |
| 7,169,060 | B2 | 1/2007 | Stevens et al. | |
| 7,186,190 | B1 * | 3/2007 | Beach et al. | 473/335 |
| 7,189,169 | B2 | 3/2007 | Billings | |
| 7,198,575 | B2 | 4/2007 | Beach et al. | |
| 7,223,180 | B2 | 5/2007 | Willett et al. | |
| 7,247,103 | B2 * | 7/2007 | Beach et al. | 473/324 |
| 7,252,600 | B2 | 8/2007 | Murphy et al. | |
| 7,255,654 | B2 | 8/2007 | Murphy et al. | |
| 7,278,927 | B2 | 10/2007 | Gibbs et al. | |
| 7,448,963 | B2 | 11/2008 | Beach et al. | |
| 7,731,603 | B2 | 6/2010 | Beach et al. | |
| 7,736,245 | B2 * | 6/2010 | Hasegawa | 473/319 |
| 7,798,914 | B2 * | 9/2010 | Noble et al. | 473/324 |
| 7,850,542 | B2 | 12/2010 | Cackett et al. | |
| 8,128,508 | B2 * | 3/2012 | Sato | 473/289 |
| 8,353,786 | B2 | 1/2013 | Beach et al. | |
| 2001/0049310 | A1 | 12/2001 | Cheng et al. | |
| 2002/0022535 | A1 * | 2/2002 | Takeda | 473/346 |
| 2002/0072434 | A1 | 6/2002 | Yabu | |
| 2002/0137576 | A1 | 9/2002 | Dammen | |
| 2002/0160854 | A1 | 10/2002 | Beach et al. | |
| 2003/0130059 | A1 | 7/2003 | Billings | |
| 2004/0087388 | A1 | 5/2004 | Beach et al. | |
| 2004/0242343 | A1 | 12/2004 | Chao | |
| 2004/0248667 | A1 | 12/2004 | Cackett et al. | |
| 2005/0101404 | A1 | 5/2005 | Long et al. | |
| 2005/0239575 | A1 | 10/2005 | Chao et al. | |
| 2006/0058112 | A1 | 3/2006 | Haralason et al. | |
| 2006/0154747 | A1 | 7/2006 | Beach | |
| 2007/0105647 | A1 | 5/2007 | Beach et al. | |
| 2007/0105648 | A1 | 5/2007 | Beach et al. | |
| 2007/0105649 | A1 | 5/2007 | Beach et al. | |
| 2007/0105650 | A1 | 5/2007 | Beach et al. | |
| 2007/0105651 | A1 | 5/2007 | Beach et al. | |
| 2007/0105652 | A1 | 5/2007 | Beach et al. | |
| 2007/0105653 | A1 | 5/2007 | Beach et al. | |
| 2007/0105654 | A1 | 5/2007 | Beach et al. | |
| 2007/0105655 | A1 | 5/2007 | Beach et al. | |
| 2007/0129167 | A1 | 6/2007 | Matsunaga | |
| 2008/0261717 | A1 | 10/2008 | Hoffman et al. | |
| 2008/0280698 | A1 | 11/2008 | Hoffman et al. | |
| 2009/0017938 | A1 | 1/2009 | Yokota | |
| 2009/0088271 | A1 | 4/2009 | Beach et al. | |
| 2010/0216570 | A1 | 8/2010 | Beach et al. | |

FOREIGN PATENT DOCUMENTS

| | | | | | |
|---|---|---|---|---|---|
| EP | 1001175 | A2 | | 5/2000 | |
| GB | 194823 | | | 12/1921 | |
| JP | 06-304271 | | | 4/1993 | |
| JP | 05-317465 | | | 12/1993 | |
| JP | 06-126004 | | | 5/1994 | |
| JP | 07275411 | A | * | 10/1995 | A63B 53/04 |
| JP | 08243194 | A | * | 9/1996 | A63B 53/04 |
| JP | 09-028844 | | | 2/1997 | |
| JP | 09173510 | | | 7/1997 | |
| JP | 09173510 | A | * | 7/1997 | A63B 53/04 |
| JP | 09-308717 | | | 12/1997 | |
| JP | 09-327534 | | | 12/1997 | |
| JP | 10-234902 | | | 8/1998 | |
| JP | 10-277187 | | | 10/1998 | |
| JP | 10277182 | A | * | 10/1998 | A63B 53/04 |
| JP | 11299937 | | | 11/1999 | |
| JP | 11299937 | A | * | 11/1999 | A63B 53/04 |
| JP | 2000176056 | A | * | 6/2000 | A63B 53/04 |
| JP | 2001238988 | | | 9/2001 | |
| JP | 2001238988 | A | * | 9/2001 | A63B 53/04 |
| JP | 2002143350 | A | * | 5/2002 | A63B 53/04 |
| JP | 2002315854 | | | 10/2002 | |
| JP | 2003102877 | A | * | 4/2003 | A63B 53/04 |
| JP | 2003290396 | A | * | 10/2003 | A63B 53/04 |
| JP | 2004135730 | | | 5/2004 | |
| JP | 2004222911 | | | 8/2004 | |
| JP | 2004267438 | | | 9/2004 | |
| JP | 2005160947 | A | * | 6/2005 | A63B 53/04 |
| JP | 2005305169 | | | 11/2005 | |
| JP | 2006204604 | | | 8/2006 | |
| JP | 2006204604 | A | * | 8/2006 | |
| JP | 2007500066 | | | 1/2007 | |
| JP | 2007029588 | A | * | 2/2007 | |
| JP | 2007151758 | | | 6/2007 | |
| JP | 2008220665 | | | 9/2008 | |
| JP | 2009018049 | | | 1/2009 | |
| WO | WO88/02642 | | | 4/1988 | |
| WO | WO01/66199 | | | 9/2001 | |
| WO | WO02/062501 | | | 8/2002 | |
| WO | WO03/061773 | | | 7/2003 | |

OTHER PUBLICATIONS

Office action from the U.S. Patent and Trademark Office in U.S. Appl. No. 12/006,060, dated Jul. 29, 2011.

Final Office action from the U.S. Patent and Trademark Office in U.S. Appl. No. 12/006,060, dated Apr. 12, 2011.

Final Office action from the U.S. Patent and Trademark Office in U.S. Appl. No. 12/006,060, dated Nov. 14, 2011.

Callaway Golf, World's Straightest Driver: FT-i Driver downloaded from www.callawaygolf.com/ft%2Di/driver.aspx?lang=en on Apr. 5, 2007.

Final Office action from the U.S. Patent and Trademark Office in U.S. Appl. No. 12/006,060, dated Mar. 9, 2010.

Jackson, Jeff, The Modern Guide to Golf Clubmaking, Ohio: Dynacraft Golf Products, Inc., copyright 1994, p. 237.

Nike Golf, Sasquatch 460, downloaded from www.nike.com/nikegolf/index.htm on Apr. 5, 2007.

Nike Golf, Sasquatch Sumo Squared Driver, downloaded from www.nike.com/nikegolf/index.htm on Apr. 5, 2007.

Office action from the U.S. Patent and Trademark Office in U.S. Appl. No. 12/006,060, dated Jul. 30, 2009.

Taylor Made Golf Company Inc., R7 460 Drivers, downloaded from www.taylormadegolf.com/product_detail.asp?pID=14section=overview on Apr. 5, 2007.

Titleist 907D1, downloaded from www.tees2greens.com/forum/Uploads/Images/7ade3521-192b-4611-870b-395d.jpg on Feb. 1, 2007.

Final Office action from the U.S. Patent and Trademark Office in U.S. Appl. No. 11/863,198, dated Oct. 5, 2009.

Office action from the U.S. Patent and Trademark Office in U.S. Appl. No. 11/863,198, dated Mar. 13, 2009.

Office action from the U.S. Patent and Trademark Office in U.S. Appl. No. 12/006,060, dated Dec. 27, 2010.

(56) References Cited

OTHER PUBLICATIONS

Office action from the U.S. Patent and Trademark Office in U.S. Appl. No. 12/775,359, dated Jan. 28, 2011.
Final Office action from the U.S. Patent and Trademark Office in U.S. Appl. No. 12/775,359, dated Jan. 17, 2013.
Office action from the Japanese Patent Office in Patent Application No. 2008-247526, dated Nov. 20, 2012.
Office action from the Japanese Patent Office in Patent Application No. 2008-264852, dated Dec. 3, 2012.
Office action from the U.S. Patent and Trademark Office in U.S. Appl. No. 12/775,359, dated Jun. 22, 2012.

* cited by examiner

GOLF CLUB

CROSS REFERENCE TO RELATED APPLICATIONS

This application is a continuation-in-part of U.S. patent application Ser. No. 12/006,060, filed Dec. 28, 2007, which is a continuation-in-part of U.S. patent application Ser. No. 11/863,198, filed Sep. 27, 2007 now U.S. Pat. No. 7,731,603, both of which are incorporated herein by reference.

Other applications and patents concerning golf club heads include U.S. patent application Ser. No. 11/871,933, filed Oct. 12, 2007, U.S. patent application Ser. No. 11/669,891, U.S. patent application Ser. No. 11/669,894, U.S. patent application Ser. No. 11/669,900, U.S. patent application Ser. No. 11/669,907, U.S. patent application Ser. No. 11/669,910, U.S. patent application Ser. No. 11/669,916, U.S. patent application Ser. No. 11/669,920, U.S. patent application Ser. No. 11/669,925, and U.S. patent application Ser. No. 11/669,927, all filed on Jan. 31, 2007, which are continuations of U.S. patent application Ser. No. 11/067,475, filed Feb. 25, 2005, now U.S. Pat. No. 7,186,190, which is a continuation-in-part of U.S. patent application Ser. No. 10/785,692, filed Feb. 23, 2004, now U.S. Pat. No. 7,166,040, which is a continuation-in-part of U.S. patent application Ser. No. 10/290,817, now U.S. Pat. No. 6,773,360. These applications are incorporated herein by reference.

FIELD

The present application concerns golf clubs and golf club heads, and more particularly, golf clubs and golf club heads that incorporate features to provide increased forgiveness for off-center hits, reduced weight and/or increased head speed during a swing, among other advantages. Unique combinations of moments of inertia, inverted cone technology, club head face characteristics and golf club component characteristics are described.

BACKGROUND

Golf club head manufacturers and designers are constantly looking for ways to improve golf club head performance, which includes the forgiveness of the golf club head, while having an aesthetic appearance. Generally, "forgiveness" can be defined as the ability of a golf club head to reduce the effects of mishits, i.e., hits resulting from striking the golf ball at a less than an ideal impact location on the golf club head, on the shot shape and distance of a golf ball struck the by club.

Golf club head performance can be directly affected by the moments of inertia of the club head. A moment of inertia is the measure of a club head's resistance to twisting about the golf club head's center of gravity upon impact with a golf ball. Generally, the higher the moments of inertia of a golf club head, the less the golf club head twists at impact with a golf ball, particularly during "off-center" impacts with a golf ball, the greater the forgiveness of the golf club head and probability of hitting a straight golf shot. Further, higher moments of inertia typically result in greater ball speed upon impact with the golf club head, which can translate into increased golf shot distance.

In general, the moment of inertia of a mass about a given axis is proportional to the square of the distance of the mass away from the axis. In other words, the greater the distance of a mass away from a given axis, the greater the moment of inertia of the mass about the given axis. Accordingly, golf club head designers and manufacturers have sought to increase the moment of inertia about one or more golf club head axes, which are typically axes extending through the golf club head center of gravity, by increasing the distance of the head mass away from the axes of interest.

In an effort to increase the forgiveness of a golf club head, some golf club head manufacturers have focused on the size of the golf club head striking surface. Generally, the larger the striking surface, the greater the forgiveness of the golf club head. However, to maintain the durability of the striking surface, increasing the size of the striking surface typically requires increasing the thickness of the face, e.g., face plate, defining the striking surface, which has a direct effect on the Coefficient of Restitution (COR) of the striking surface, or the measurement of the ability of the striking surface to rebound the ball, e.g., the spring-like effect of the surface. In a simplified form, the COR may be expressed as a percentage of the speed of a golf ball immediately after being struck by the club head divided by the speed of the club head upon impact with the golf ball, with the measurement of the golf ball speed and club head speed governed by United States Golf Association guidelines United States Golf Association (USGA) regulations and constraints on golf club head shapes, sizes and other characteristics tend to limit the moments of inertia and COR achievable by a golf club head. According to the most recent version of the USGA regulations, golf club heads must, inter alia, be generally plain in shape, have envelope dimensions at or below maximum envelope dimensions (maximum height of 2.8 inches, maximum width of 5.0 inches and a maximum depth of 5.0 inches), and have a volume at or below a maximum head volume of 470 $cm^3$. It should be noted that this maximum volume constraint of 470 $cm^3$ is well below the volume of the maximum envelope dimensions. Note that the 470 $cm^3$ USGA limit includes a 10 $cm^3$ tolerance (i.e., 460 $cm^3$+10 $cm^3$). Further, the USGA regulations require the COR value to be less than 0.830, or have a Pendulum Characteristic Time (PCT) of less than 257 microseconds. The COR and PCT limits just identified each include a tolerance.

Often, golf club manufacturers are faced with the choice of increasing one performance characteristic at the expense of another. For example, to promote forgiveness, some conventional golf club heads focus on increasing the moments of inertia at the expense of increased striking surface size. In these golf club heads, as much of the golf club head mass as possible is moved away from the center of gravity. However, due to mass constraints resulting from attempting to achieve the desired swing weight (e.g., driver club head mass typically ranges from about 185 g to about 215 g), the more mass that is distributed away from the center of gravity, the less mass available for the face. With less mass available for the face, to remain within the USGA constraints governing COR and PCT, the golf club head face thickness, and thus the club head striking surface size, is limited. Accordingly, with these conventional golf club heads, the forgiveness of the heads can be increased by the increased moments of inertia, but limited by the resulting constraints on the size of the golf club head striking surface.

Conversely, to promote forgiveness, some conventional golf club heads focus on increasing the size of the golf club head striking surface at the expense of increased moments of inertia, potentially also sacrificing desired center-of-gravity ("CG") properties. As described above, with conventional face designs, the larger the size of the striking surface, the thicker and more massive the face must be to comply with USGA constraints. With more mass dedicated to the face, there is typically more mass closer to the center of gravity, and less mass, e.g., discretionary mass, available for moving away from the center of gravity. Accordingly, with these conventional golf club heads, the forgiveness of the heads can be increased by the increased striking surface sizes, but limited by the resulting constraints on the achievable moments of inertia.

As described above, golf club designers and manufacturers have struggled to design USGA-conforming golf club heads that have both high moments of inertia and large striking surface sizes for improved forgiveness.

SUMMARY

This application addresses at least the foregoing and discloses, inter alia, golf club heads that provide improved forgiveness as well as golf clubs that may have particular dimensional and/or weight properties to promote increased performance.

This application describes golf club heads that include a body defining an interior cavity. The golf club heads also include a sole positioned at a bottom portion of the golf club head, a crown positioned at a top portion, and a skirt positioned around a periphery between the sole and crown. The body has a forward portion and a rearward portion. Additionally, the golf club heads include a face positioned at the forward portion of the body, and the face defines a striking surface having an ideal impact location at a golf club head origin. The head origin includes an x-axis tangential to the face and generally parallel to the ground when the head is ideally positioned, a y-axis generally perpendicular to the x-axis and generally parallel to the ground when the head is ideally positioned, and a z-axis perpendicular to both the x-axis and y-axis. The positive direction for the axis is toe-to-heel, for the y-axis is front-to-back, and for the z-axis is sole-to-crown.

According to a first aspect, this application describes golf club heads that have a moment of inertia about a golf club head center of gravity z-axis generally parallel to the head origin z-axis greater than approximately 490 kg·mm$^2$. The face has a thickness along the head origin x-axis between $t_{min}$ and $t_{max}$ for at least 50% of the x-axis coordinates x within a first range between approximately −10 mm and approximately −50 mm, and a second range between approximately 10 mm and approximately 50 mm, where $$t_{min}=1.6+0.002378(40-|x|)^2, \text{ and} \quad (1)$$

$$t_{max}=2.5+0.002854(40-|x|)^2. \quad (2)$$

The thickness of a first portion of the face within at respective one of the first and second ranges can be at least approximately 2 mm greater than a second portion of the face within the respective one of the first and second ranges.

In some instances, the thickness of the face can be between $t_{min}$ and $t_{max}$ for at least 80% of the x-axis coordinates x within the first and second ranges.

Golf club heads according to the first aspect can have a moment of inertia about a golf club head center of gravity x-axis generally parallel to the head origin x-axis greater than approximately 280 kg·mm$^2$.

Golf club heads of the first aspect can have a center of gravity with an x-axis coordinate between approximately 0.0 mm and approximately 6.0 mm, and a z-axis coordinate between approximately 0.0 mm and approximately −6.0 mm.

In some embodiments, the striking surface has an area between approximately 3,500 mm$^2$ and approximately 4,500 mm$^2$. In other embodiments, the striking surface may have an area greater than approximately 4,500 mm$^2$, and may be up to and including approximately 5,500 mm$^2$, for example.

The face can also have a thickness along the head origin z-axis, between $t_{min}$ and $t_{max}$ for at least 50% of the z-axis coordinates z within a third range between approximately −10 mm and approximately −30 mm, and a fourth range between approximately 10 mm and approximately 30 mm, where $$t_{min}=1.6+0.002378(40-|z|)^2, \text{ and} \quad (1)$$

$$t_{max}=2.5+0.002854(40-|z|)^2. \quad (2)$$

According to a second aspect, this application describes golf club heads that have a moment of inertia about a golf club head center of gravity x-axis generally parallel to the head origin x-axis greater than approximately 280 kg·mm$^2$. The face has a thickness along the head origin z-axis between $t_{min}$ and $t_{max}$ for at least 50% of the z-axis coordinates z within a first range between approximately −10 mm and approximately −30 mm, and a second range between approximately 10 mm and approximately 30 mm, where $$t_{min}=1.6+0.002378(40-|z|)^2, \text{ and} \quad (1)$$

$$t_{max}=2.5+0.002854(40-|z|)^2. \quad (2)$$

The thickness of a first portion of the face within at respective one of the first and second ranges can be at least approximately 2 mm greater than a second portion of the face within the respective one of the first and second ranges for golf clubs according to the second aspect.

The thickness of the face can be between $t_{min}$ and $t_{max}$ for at least 80% of the z-axis coordinates z within the first and second ranges.

The striking surface of golf clubs according to the second aspect can have an area between approximately 3,500 mm$^2$ and approximately 4,500 mm$^2$. In other embodiments, the striking surface may have an area greater than approximately 4,500 mm$^2$, and may be up to and including approximately 5,500 mm$^2$, for example.

The face of golf clubs according to the second aspect can have a thickness along the head origin x-axis, the thickness being between $t_{min}$ and $t_{max}$ for at least 50% of the x-axis coordinates x within a third range between approximately −10 mm and approximately −50 mm, and a fourth range between approximately 10 mm and approximately 50 mm, where $$t_{min}=1.6+0.002378(40-|x|)^2, \text{ and} \quad (1)$$

$$t_{max}=2.5+0.002854(40-|x|)^2. \quad (2)$$

Some embodiments according to the second aspect have a moment of inertia about a golf club head center of gravity z-axis generally parallel to the head origin z-axis greater than approximately 490 kg·mm$^2$. Some embodiments have a center of gravity with an x-axis coordinate between approximately 0.0 mm and approximately 6.0 mm, and a z-axis coordinate between approximately 0.0 mm and approximately −6.0 mm.

According to a third aspect, this application describes golf club heads that have a moment of inertia about a golf club head center of gravity z-axis generally parallel to the head origin z-axis greater than approximately 490 kg·mm$^2$, and a moment of inertia about a golf club head center of gravity x-axis generally parallel to the head origin x-axis greater than approximately 280 kg·mm$^2$. The face has a thickness along a radial axis extending tangential to and radially outwardly away from the golf club head origin between $t_{min}$ and $t_{max}$ along at least 50% of the distances r away from the golf club head origin along the radial axis equal to or greater than approximately 10 mm and equal to or less than approximately 50 mm, where $$t_{min}=1.6+0.002378(40-r)^2, \text{ and} \quad (1)$$

$$t_{max}=2.5+0.002854(40-r)^2. \quad (2)$$

Golf club heads according to the third aspect can have a striking surface area between approximately 3,500 $mm^2$ and approximately 5,500 $mm^2$. Golf club heads of the third aspect can have a center of gravity with an x-axis coordinate between approximately 0.0 mm and approximately 6.0 mm, and a z-axis coordinate between approximately 0.0 mm and approximately −6.0 mm.

According to a fourth aspect, golf club heads having a moment of inertia about a golf club head center of gravity z-axis generally parallel to the head origin z-axis greater than approximately 500 kg·$mm^2$ are disclosed. The face of golf clubs heads according to the fourth aspect has a bending stiffness along the head origin x-axis, the bending stiffness being between $BS_{min}$ and $BS_{max}$ for at least 50% of the x-axis coordinates x within a first range between approximately −10 mm and approximately −50 mm, and a second range between approximately 10 mm and approximately 50 mm, where $$BS_{min}=1.1\cdot10^5[1.6+0.002378(40-|x|)^2]^3, \text{ and} \quad (1)$$

$$BS_{max}=1.1\cdot10^5[2.5+0.002854(40-|x|)^2]^3. \quad (2)$$

In some instances according to the fourth aspect, the face has a thickness along the head origin x-axis, the thickness being between $t_{min}$ and $t_{max}$ for at least 50% of the x-axis coordinates x within a third range between approximately −10 mm and approximately −50 mm, and a fourth range between approximately 10 mm and approximately 50 mm, where $$t_{min}=1.6+0.002378(40-|x|)^2, \text{ and} \quad (1)$$

$$t_{max}=2.5+0.002854(40-|x|)^2. \quad (2)$$

The face can have a thickness along the head origin z-axis, the thickness being between $t_{min}$ and $t_{max}$ for at least 50% of the z-axis coordinates z within a third range between approximately −10 mm and approximately −30 mm, and a fourth range between approximately 10 mm and approximately 30 mm, where $$t_{min}=1.6+0.002378(40-|z|)^2, \text{ and} \quad (1)$$

$$t_{max}=2.5+0.002854(40-|z|)^2. \quad (2)$$

The striking surface can have an area between approximately 3,500 $mm^2$ and approximately 4,500 $mm^2$. In other embodiments, the striking surface may have an area greater than approximately 4,500 $mm^2$, and may be up to and including approximately 5,500 $mm^2$, for example.

Golf club heads can have a center of gravity with an x-axis coordinate between approximately 0.0 mm and approximately 6.0 mm, and a z-axis coordinate between approximately 0.0 mm and approximately −6.0 mm.

Golf club heads according to a fifth aspect have a moment of inertia about a golf club head center of gravity x-axis generally parallel to the head origin x-axis greater than approximately 280 kg·$mm^2$. The face has a bending stiffness along the head origin z-axis, the bending stiffness being between $BS_{min}$ and $BS_{max}$ for at least 50% of the z-axis coordinates z within a first range between approximately −10 mm and approximately −30 mm, and a second range between approximately 10 mm and approximately 30 mm, where $$BS_{min}=1.1\cdot10^5[1.6+0.002378(40-|z|)^2]^3, \text{ and} \quad (1)$$

$$BS_{max}=1.1\cdot10^5[2.5+0.002854(40-|z|)^2]^3. \quad (2)$$

Golf club heads according to the fifth aspect can have a thickness along the head origin x-axis, the thickness being between $t_{min}$ and $t_{max}$ for at least 50% of the x-axis coordinates x within a third range between approximately −10 mm and approximately −50 mm, and a fourth range between approximately 10 mm and approximately 50 mm, where $$t_{min}=1.6+0.002378(40-|x|)^2, \text{ and} \quad (1)$$

$$t_{max}=2.5+0.002854(40-|x|)^2. \quad (2)$$

The face in some embodiments has a thickness along the head origin z-axis, the thickness being between $t_{min}$ and $t_{max}$ for at least 50% of the z-axis coordinates z within a third range between approximately −10 mm and approximately −30 mm, and a fourth range between approximately 10 mm and approximately 30 mm, where $$t_{min}=1.6+0.002378(40-|z|)^2, \text{ and} \quad (1)$$

$$t_{max}=2.5+0.002854(40-|z|)^2. \quad (2)$$

The striking surface can have an area between approximately 3,500 $mm^2$ and approximately 4,500 $mm^2$. In other embodiments, the striking surface may have an area greater than approximately 4,500 $mm^2$, and may be up to and including approximately 5,500 $mm^2$, for example.

Golf club heads of the fifth aspect can have a center of gravity with an x-axis coordinate between approximately 0.0 mm and approximately 6.0 mm, and a z-axis coordinate between approximately 0.0 mm and approximately −6.0 mm.

Golf clubs according to a sixth aspect may include a golf club head, golf club shaft, and golf club grip. The golf club may include one or more reduced weight portions as compared to a conventional club, as will be explained in more detail later.

The foregoing and other features and advantages of the golf club head will become more apparent from the following detailed description, which proceeds with reference to the accompanying figures.

DETAILED DESCRIPTION

In the following description, certain terms may be used such as "up," "down,", "upper," "lower," "horizontal," "vertical," "left," "right," and the like. These terms are used, where applicable, to provide some clarity of description when dealing with relative relationships, particularly with respect to the illustrated embodiments. These terms are not, however, intended to imply absolute relationships, positions, and/or orientations. For example, with respect to an object, an "upper" surface can become a "lower" surface simply by turning the object over. Nevertheless, it is still the same object.

Figure 1:
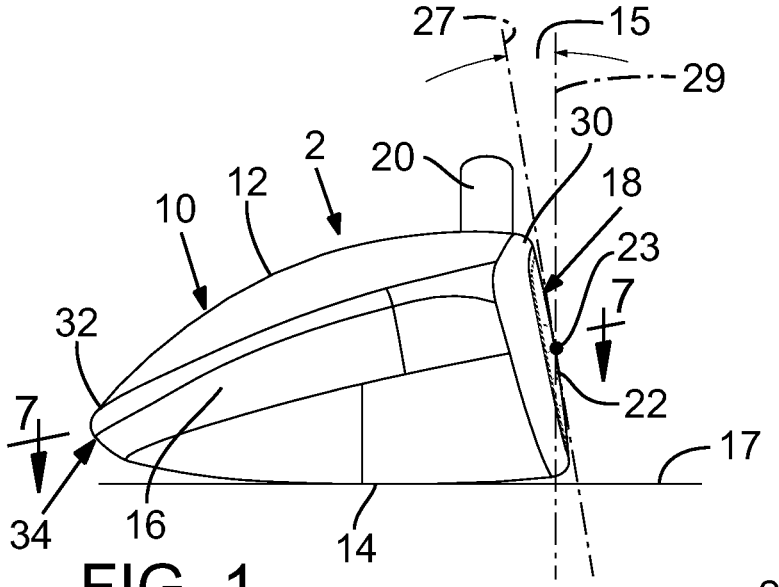
FIG. 1 is a side elevation view of a golf club head according to a first embodiment.

As illustrated in FIGS. 1-8, a wood-type (e.g., driver or fairway wood) golf club head, such as golf club head 2, includes a hollow body 10. The body 10 includes a crown 12, a sole 14, a skirt 16, a striking face, or face portion, 18 defining an interior cavity 79 (see FIGS. 7-8). The body 10 can include a hosel 20, which defines a hosel bore 24 adapted to receive a golf club shaft (see FIG. 6). The body 10 further includes a heel portion 26, a toe portion 28, a front portion 30, and a rear portion 32. The club head 2 also has a volume, typically measured in cubic-centimeters ($cm^3$), equal to the volumetric displacement of the club head 2. In some implementations, the golf club head 2 has a volume between approximately 400 $cm^3$ and approximately 490 $cm^3$, and a total mass between approximately 185 g and approximately 215 g. Referring to FIG. 1, in one specific implementation, the golf club head 2 has a volume of approximately 458 $cm^3$ and a total mass of approximately 200 g.

Figure 5:
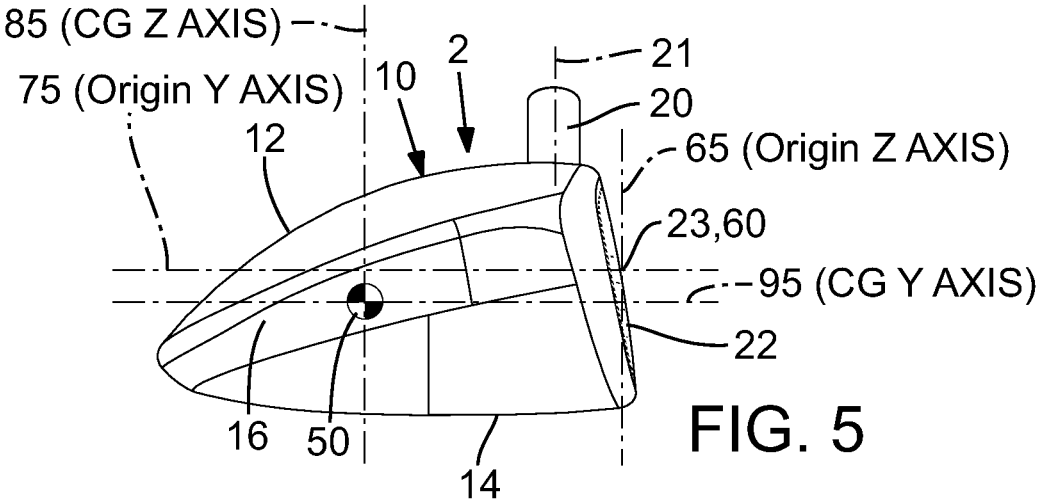
FIG. 5 is a side elevation view of the golf club head of FIG. 1 showing a center of gravity coordinate system.
Figure 6:
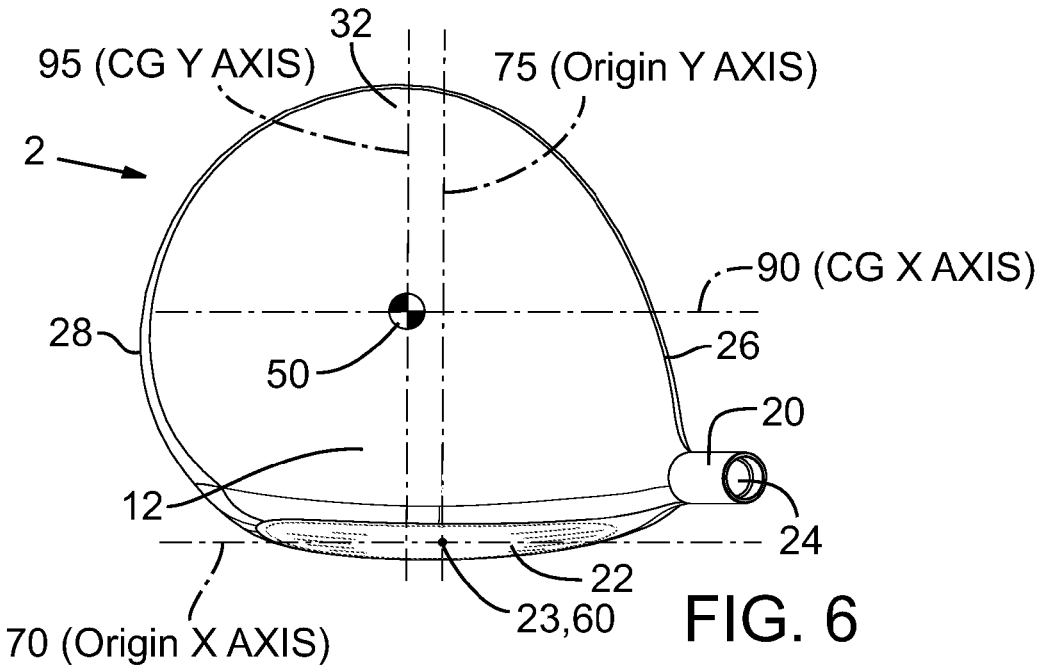
FIG. 6 is a top plan view of the golf club head of FIG. 1.

The crown 12 is defined as an upper portion of the club head (1) above a peripheral outline 34 of the club head as viewed from a top-down direction; and (2) rearwards of the topmost portion of a ball striking surface 22 of the striking face 18 (see FIG. 6). The striking surface 22 is defined as a front or external surface of the striking face 18 and is adapted for impacting a golf ball (not shown). In several embodiments, the striking face or face portion 18 can be a striking plate attached to the body 10 using conventional attachment techniques, such as welding, as will be described in more detail below. In some embodiments, the striking surface 22 can have a bulge and roll curvature. For example, referring to FIGS. 5 and 6, the striking surface 22 can have a bulge and roll each with a radius of approximately 305 mm.

The sole 14 is defined as a lower portion of the club head 2 extending upwards from a lowest point of the club head when the club head is ideally positioned, i.e., at a proper address position relative to a golf ball on a level surface. In some implementations, the sole 14 extends approximately 50% to 60% of the distance from the lowest point of the club head to the crown 12, which in some instances, can be approximately 15 mm for a driver and between approximately 10 mm and 12 mm for a fairway wood.

A golf club head, such as the club head 2, is at its proper address position when the longitudinal axis 21 of the hosel 20 or shaft is substantially normal to the target direction and at the proper lie angle such that the scorelines are substantially horizontal (e.g., approximately parallel to the ground plane 17) and the face angle relative to target line is substantially square (e.g., the horizontal component of a vector normal to the geometric center of the striking surface 22 substantially points towards the target line). If the faceplate 18 does not have horizontal scorelines, then the proper lie angle is set at an approximately 60-degrees. The loft angle 15 is the angle defined between a face plane 27, defined as the plane tangent to an ideal impact location 23 on the striking surface 22, and a vertical plane 29 relative to the ground 17 when the club head 2 is at proper address position. Lie angle 19 is the angle defined between a longitudinal axis 21 of the hosel 20 or shaft and the ground 17 when the club head 2 is at proper address position. The ground, as used herein, is assumed to be a level plane.

The skirt 16 includes a side portion of the club head 2 between the crown 12 and the sole 14 that extends across a periphery 34 of the club head, excluding the striking surface 22, from the toe portion 28, around the rear portion 32, to the heel portion 26.

Figure 4:
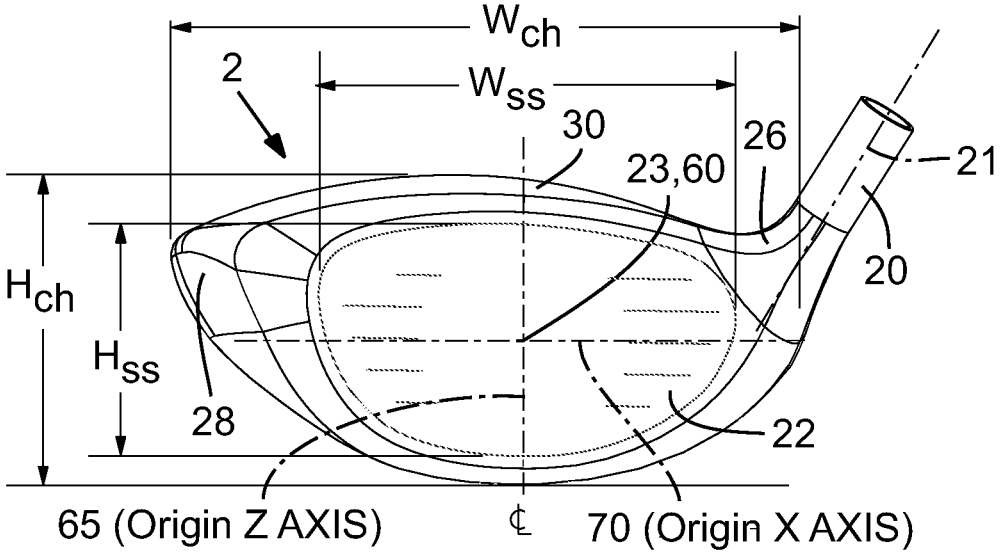
FIG. 4 is a front elevation view of the golf club head of FIG. 1 showing a golf club head origin coordinate system.

In the illustrated embodiment, the ideal impact location 23 of the golf club head 2 is disposed at the geometric center of the striking surface 22 (see FIG. 4). The ideal impact location 23 is typically defined as the intersection of the midpoints of a height ($H_{ss}$) and width ($W_{ss}$) of the striking surface 22. Both $H_{ss}$ and $W_{ss}$ are determined using the striking face curve ($S_{ss}$). The striking face curve is bounded on its periphery by all points where the face transitions from a substantially uniform bulge radius (face heel-to-toe radius of curvature) and a substantially uniform roll radius (face crown-to-sole radius of curvature) to the body (see e.g., FIG. 4). In the illustrated example, $H_{ss}$ is the distance from the periphery proximate to the sole portion of $S_{ss}$ to the perhiphery proximate to the crown portion of $S_{ss}$ measured in a vertical plane (perpendicular to ground) that extends through the geometric center of the face (e.g., this plane is substantially normal to the x-axis). Similarly, $W_{ss}$ is the distance from the periphery proximate to the heel portion of $S_{ss}$ to the periphery proximate to the toe portion of $S_{ss}$ measured in a horizontal plane (e.g., substantially parallel to ground) that extends through the geometric center of the face (e.g., this plane is substantially normal to the z-axis). See USGA "Procedure for Measuring the Flexibility of a Golf Clubhead," Revision 2.0 for the methodology to measure the geometric center of the striking face. In some implementations, the golf club head face, or striking surface, 22, has a height ($H_{ss}$) between approximately 45 mm and approximately 70 mm, and a width ($W_{ss}$)

between approximately 75 mm and approximately 115 mm. Referring to FIG. 4, in one specific implementation, the striking surface 22 has a height ($H_{ss}$) of approximately 52.2 mm, width ($W_{ss}$) of approximately 90.6 mm, and total striking surface area of approximately 3,929 $mm^2$.

In some embodiments, the striking face 18 is made of a composite material such as described in U.S. Patent Application Publication Nos. 2005/0239575 and 2004/0235584, U.S. patent application Ser. No. 11/642,310, and U.S. Provisional Patent Application No. 60/877,336, which are incorporated herein by reference. In other embodiments, the striking face 18 is made from a metal alloy (e.g., titanium, steel, aluminum, and/or magnesium), ceramic material, or a combination of composite, metal alloy, and/or ceramic materials.

Figure 7:
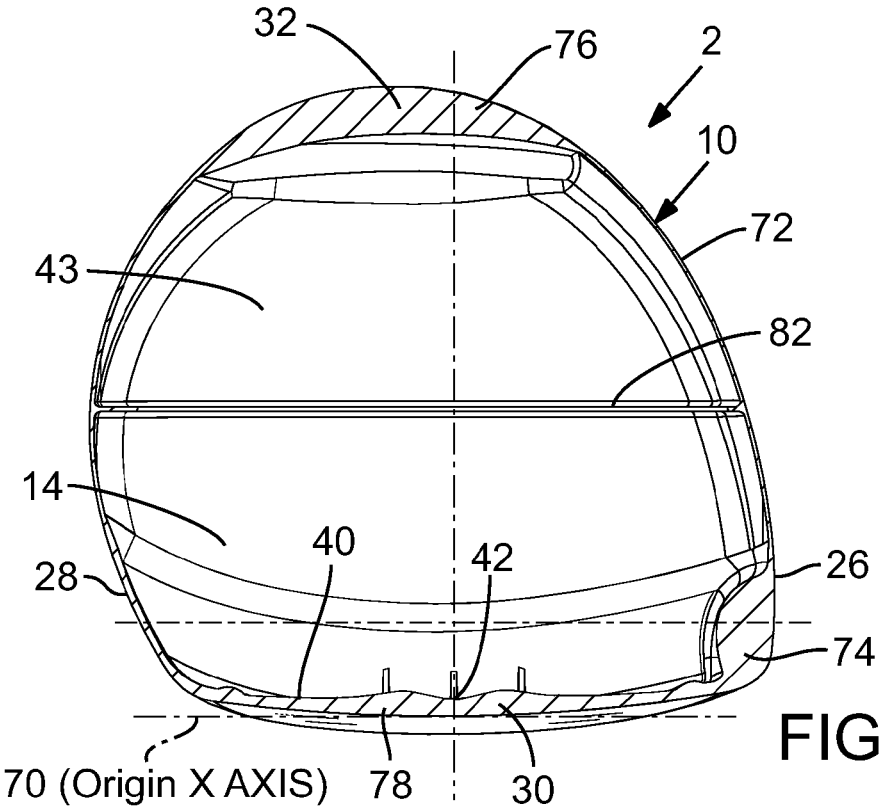
FIG. 7 is a cross-sectional view of the golf club head of FIG. 1 taken along the line 7-7 of FIG. 1.
Figure 8:
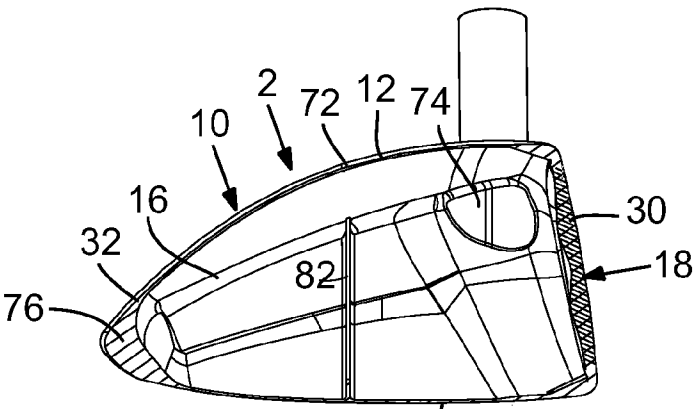
FIG. 8 is a cross-sectional side view of the golf club head of FIG. 1 taken along the line 8-8 of FIG. 2.

The striking face 18 can be a striking plate having a variable thickness such as described in U.S. Pat. No. 6,997,820, which is incorporated herein by reference. For example, as shown in FIGS. 7 and 8, striking face 18 has a thickness t defined between the striking surface 20, or exterior surface, and an interior surface 40 facing the interior cavity 43 of the golf club head 2. The striking face 18 can include a central portion 42 positioned adjacent the ideal impact location 26 on the striking surface 20. The central portion 42 can have a substantially constant thickness t. The striking face 18 also can include a diverging portion 44 extending radially outward from the central portion 42, and may be elliptical. The interior surface may be symmetrical about one or more axes and/or may be unsymmetrcial about one or more axes. See, for example, FIGS. 9-16. The thickness t of the diverging portion 44 increases in a direction radially outward from the central portion. The striking face 18 includes a converging portion 46 coupled to the diverging portion 44 via a transition portion 48. The thickness t of the converging portion 46 substantially decreases with radially outward position from the diverging portion 44 and transition portion 48. In certain instances, the transition portion 48 is an apex between the diverging and converging portions 44, 46. In other implementations, the transition portion 48 extends radially outward from the diverging portion 44 and has a substantially constant thickness t (see FIGS. 9-11).

Figure 9:
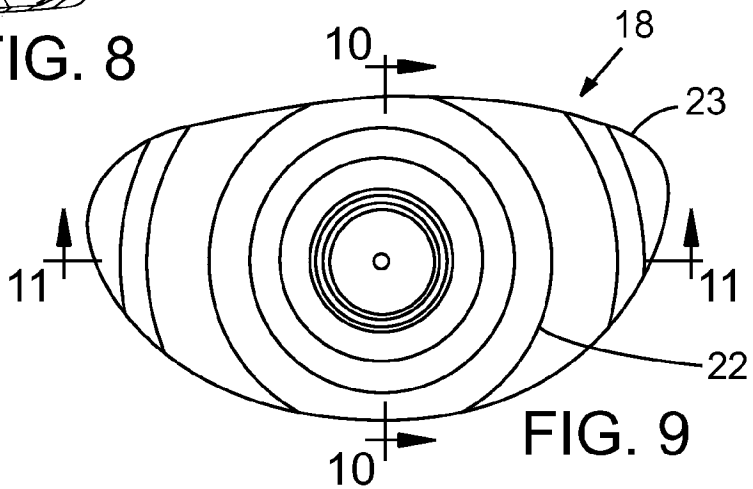
FIG. 9 is a rear elevation view of a striking face.
Figure 10:
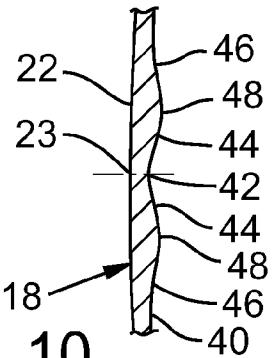
FIG. 10 is a cross-sectional side view of the striking face of FIG. 9 taken along the line 10-10 of FIG. 9.
Figure 11:
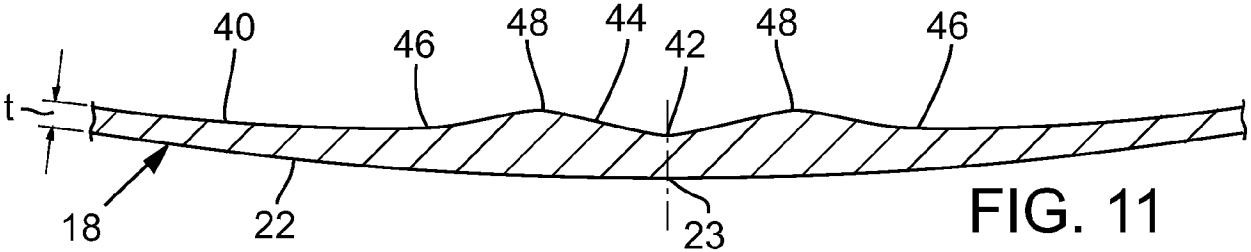
FIG. 11 is a cross-sectional side view of the striking face of FIG. 9 taken along the line 11-11 of FIG. 9.

In some embodiments, the cross-sectional profile of the striking face 18 along any axes extending perpendicular to the striking surface at the ideal impact location 23 is substantially similar as in FIGS. 9-11.

In other embodiments, the cross-sectional profile can vary, e.g., is non-symmetric. For example, in certain implementations, the cross-sectional profile of the striking face 18 along the head origin z-axis might include central, transition, diverging and converging portions as described above (see FIGS. 9-11 and 13). However, the cross-sectional profile of the striking face 18 along the head origin x-axis can include a second diverging portion 47 extending radially from the converging portion 46 and coupled to the converging portion via a transition portion 49. In alternative embodiments, the cross-sectional profile of the striking face 18 along the head origin z-axis can include a second diverging portion extending radially from the converging portion and coupled to the converging portion, as described above with regard to variation along the head origin x-axis.

Variation in thickness of the striking face 18 with distance from the geometric center of the striking face along an axis can be determined. According to one representative embodiment, a minimum thickness $t_{min}$, maximum thickness $t_{max}$, and nominal thickness $t_{nom}$ of the striking face 18 along the head origin x-axis within the effective range 10 mm≤|x|≤50 mm can be determined from the following equations:

$$t_{min}(x)=1.6+0.002378(40-x)^2 \quad (1)$$

$$t_{max}(x)=2.5+0.002854(40-x)^2 \quad (2)$$

$$t_{nom}(x)=2.05+0.002616(40-x)^2 \quad (3)$$

Figure 12:
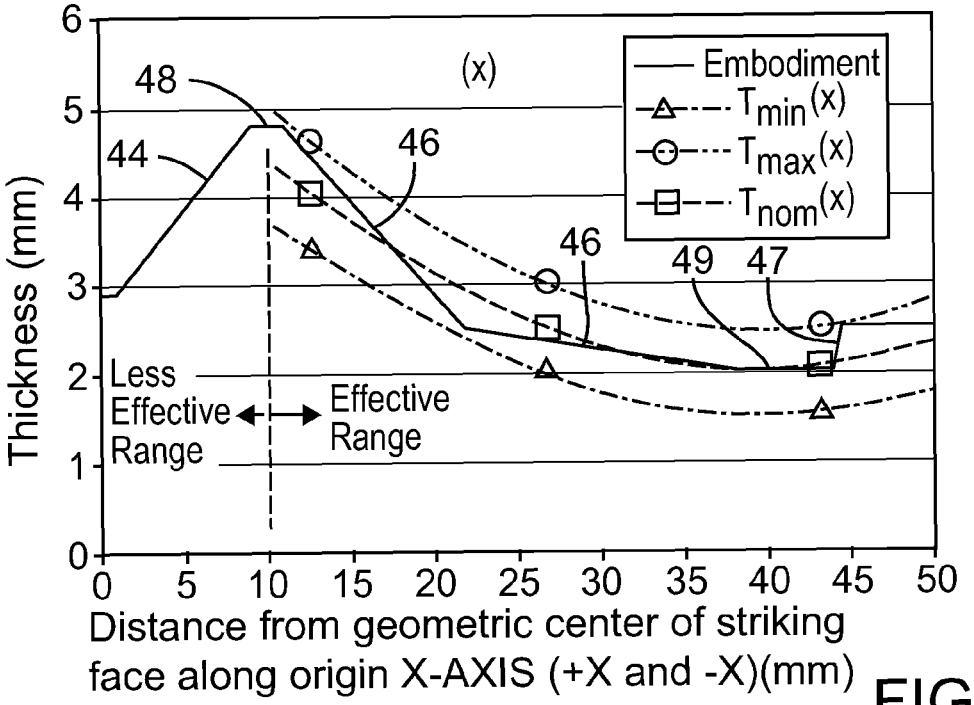
FIG. 12 is a plot of variation in striking face thickness along a club head origin x-axis.

Referring to FIG. 12, the representative thickness profiles obtained using Equations 1-3 are shown. The effective range begins about 10 mm away from the geometric center of the striking face 20 as the portion of the face 18 within the less-effective range about 0 mm≤|x|≤10 mm can have less effect on the COR of the face. However, in certain exemplary implementations, the thickness t of the face 18 within the less-effective range can be between approximately 2 mm and approximately 5 mm, and in some instances approximately 3 mm at the central portion 42. Also shown in FIG. 12 is a thickness profile for an exemplary embodiment of a striking face 18 that is bounded by, i.e., falls within, $t_{min}$ and $t_{max}$ along 100% of the effective range.

Similar to that described above, a minimum thickness $t_{min}$, maximum thickness $t_{max}$, and nominal thickness $t_{nom}$ of the striking face 18 along the head origin z-axis within the effective range of about 10 mm≤|z|≤30 mm can be determined according to the following equations:

$$t_{min}(z)=1.6+0.002378(40-z)^2 \quad (4)$$

$$t_{max}(z)=2.5+0.002854(40-z)^2 \quad (5)$$

$$t_{nom}(z)=2.05+0.002616(40-z)^2 \quad (6)$$

Figure 2:
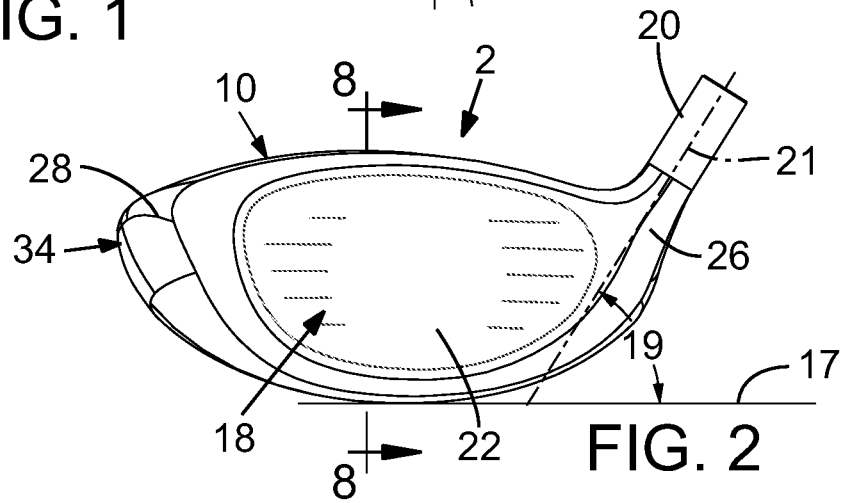
FIG. 2 is a front elevation view of the golf club head of FIG. 1.
Figure 3:
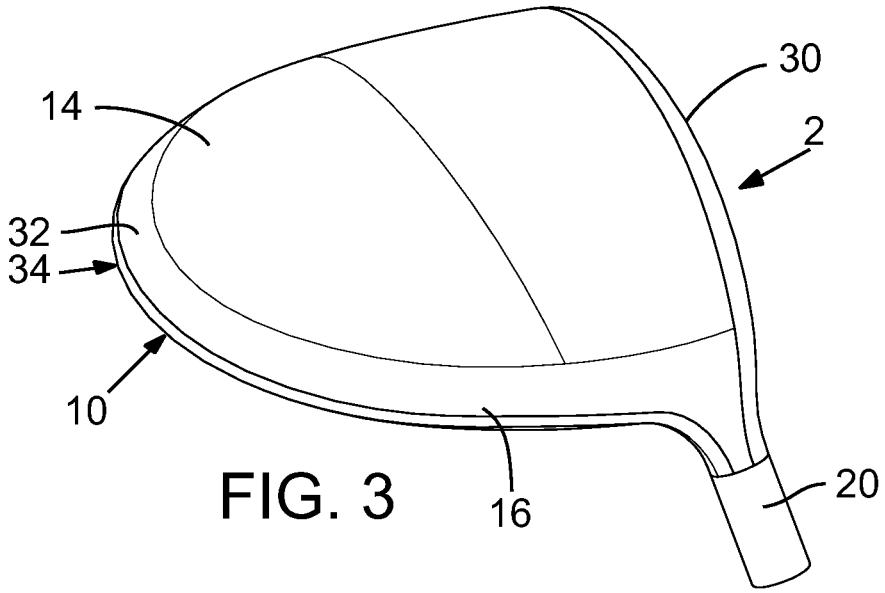
FIG. 3 is a bottom perspective view of the golf club head of FIG. 1.
Figure 13:
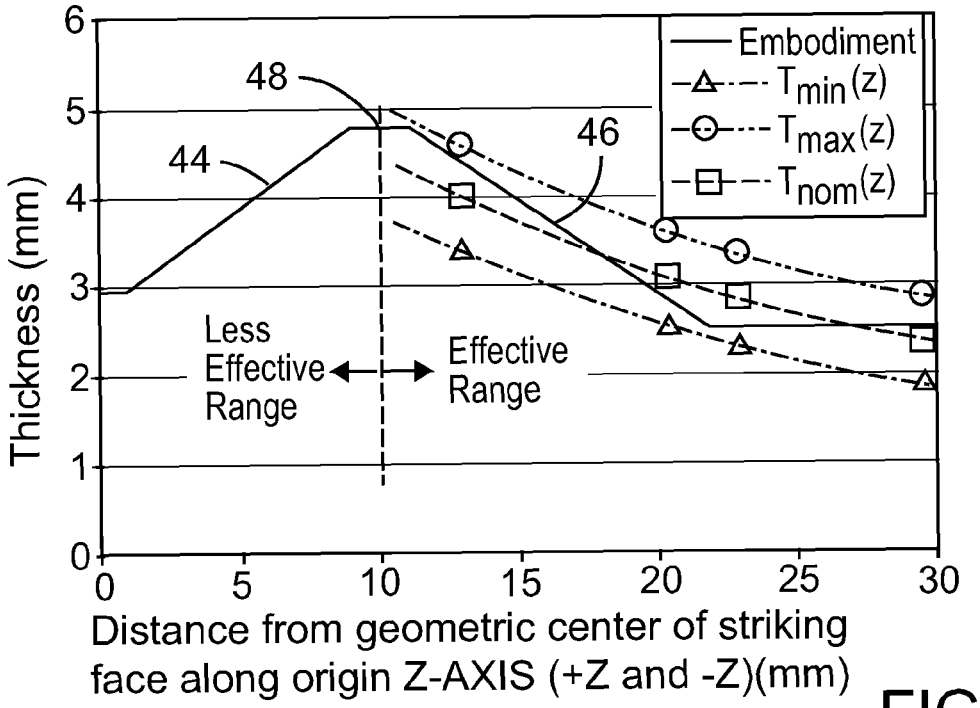
FIG. 13 is a plot of variation in striking face thickness along a club head origin z-axis.

Referring to FIG. 13, the representative thickness profiles obtained using Equations 4-6 are shown. Like the effective range along the head origin x-axis, the effective range along the head origin z-axis begins about 10 mm away from the geometric center of the striking face 18 as the portion of the face 18 within the less-effective range about 0 mm≤|z|≤10 mm can have less effect on the COR of the face. Also shown in FIG. 2 is a thickness profile for an exemplary embodiment of a striking face 18 that is bounded by, i.e., falls within, $t_{min}$ and $t_{max}$ along 100% of the effective range.

In some implementations, the above equations and constraints can be defined in terms of the radial distance away from the golf club head origin. For example, a minimum thickness $t_{min}$, maximum thickness $t_{max}$, and nominal thickness $t_{nom}$ of the striking face 18 in terms of the distance r away from the golf club head origin can be determined according to the following equations:

$$t_{min}(r)=1.6+0.002378(40-r)^2 \quad (7)$$

$$t_{max}(r)=2.5+0.002854(40-r)^2 \quad (8)$$

$$t_{nom}(r)=2.05+0.002616(40-r)^2 \quad (9)$$

where r is a distance equal to or greater than approximately 10 mm away from the golf club head origin.

Compared to constant thickness faces, the nominal thickness profiles along the x-axis and z-axis represent preferred thickness profiles for reducing the weight of the face 18, increasing the COR zone of the face and providing larger, more forgiving faces that meet the USGA COR constraints. The same or similar advantages can be achieved, however, by a face having thickness profiles along the x-axis and z-axis that are bounded by the minimum and maximum thickness profiles for the respective x-axis and z-axis along a predetermined portion of the effective range. For example, according to certain implementations, the striking face 18 can have a thickness profile along the origin x-axis that is bounded by the minimum and maximum thickness profiles along at least 50% of the effective x-axis range. Similarly, the striking face 18 can have a thickness profile along the origin z-axis that is bounded by the minimum and maximum thickness profiles along at least 50% of the effective z-axis range. In more specific implementations, the thickness profile of the striking face 18 is bounded by the minimum and maximum thickness profiles along at least 60%, 70%, 80% or 90% of the effective axis range.

In the illustrated implementation, the face 18 of golf club head 2 has a thickness profile along the x-axis (see FIG. 11) and the z-axis (see FIG. 10). The thickness profile along the x-axis of face 18 is bounded by the minimum and maximum thickness profiles along approximately 71% of the effective x-axis range. Similarly, the thickness profile along the z-axis of face 18 is bounded by the minimum and maximum thickness profiles along approximately 65% of the effective z-axis range.

In one exemplary embodiment, the face 18 is made of an isotropic monolithic material, such as titanium. The bending stiffness (BS) for an isotropic monolithic material is proportional to the modulus of elasticity (E) and thickness of the material, and can be determined according to the following equation:

$$BS=Et^3 \tag{10}$$

where t is the thickness of the face 18.

Assuming the modulus of elasticity of titanium is about $1.1\cdot10^5$ (N/mm$^2$), the minimum, maximum and nominal bending stiffness BS of the face 18 along the head origin x-axis within the effective range of about 10 mm≤|x|≤50 mm can be determined according to the following equations:

$$BS_{min}(x)=1.1\cdot10^5[1.6+0.002378(40-x)^2]^3 \tag{11}$$

$$BS_{max}(x)=1.1\cdot10^5[2.5+0.002854(40-x)^2]^3 \tag{12}$$

$$BS_{nom}(x)=1.1\cdot10^5[2.05+0.002616(40-x)^2]^3 \tag{13}$$

Figure 14:
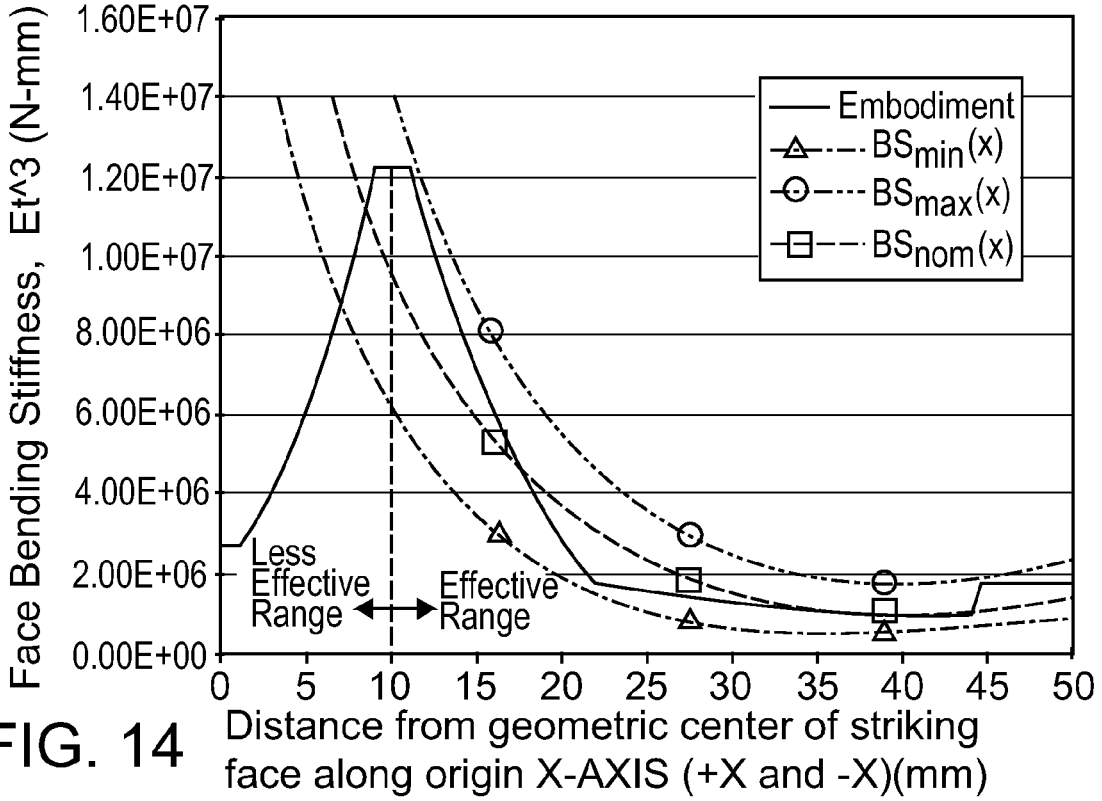
FIG. 14 is a plot of variation in striking face bending stiffness along a club head origin x-axis.
Figure 15:
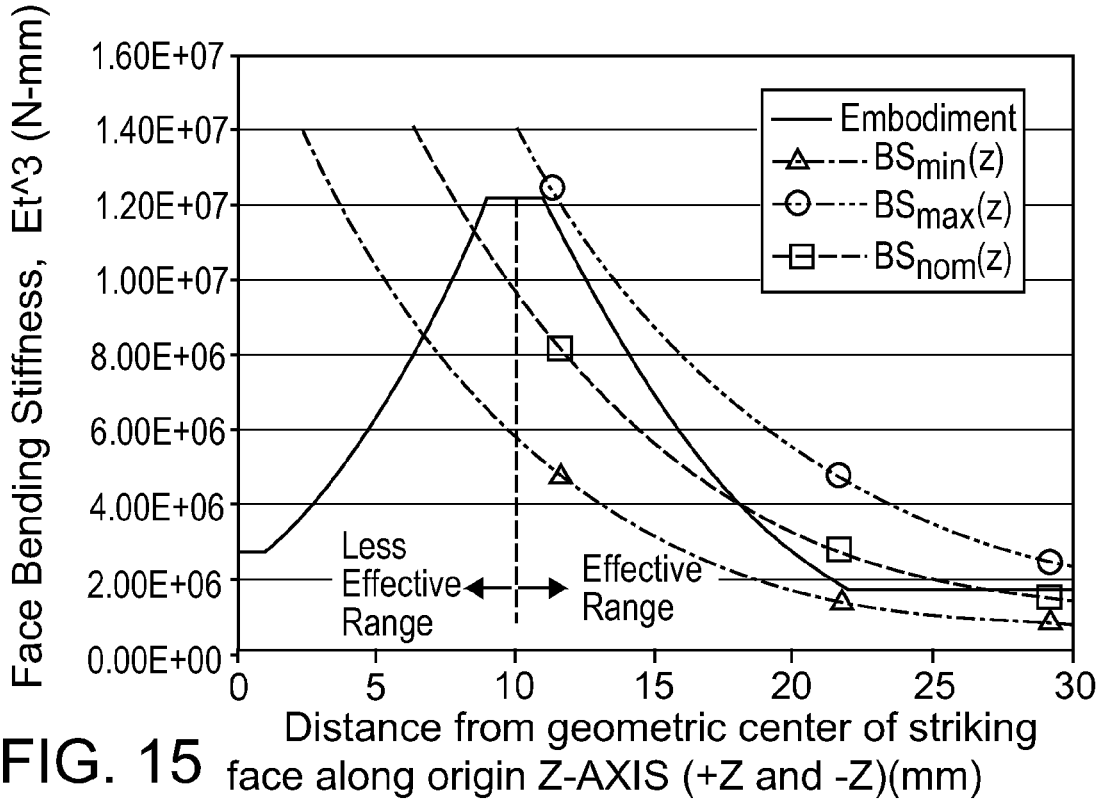
FIG. 15 is a plot of variation in striking face bending stiffness along a club head origin z-axis.

Referring to FIGS. 14-15, the representative bending stiffness profiles obtained using Equations 11-13 are shown. The effective range begins 10 mm away from the geometric center of the striking face 20 as the portion of the face 18 within the less-effective range 0 mm≤|x|≤10 mm has a relatively small effect on the stiffness of the face. However, in certain exemplary implementations, the bending stiffness of the face 18 within the less-effective range can be between approximately $9\cdot10^5$ N·mm and approximately $1.40\cdot10^7$ N·mm, and in some instances approximately $3.0\cdot10^6$ N·mm at the central portion 42. Also shown in FIG. 14 is a bending stiffness profile for an exemplary embodiment of a striking face 18 that is bounded by $BS_{min}$ and $BS_{max}$, along 100% of the effective x-axis range.

Similarly, the minimum, maximum and nominal bending stiffness BS of the face 18 along the head origin z-axis within the effective range of about 10 mm≤|x|≤30 mm can be determined according to the following equations (again assuming titanium with a Young's modulus of about $1.1\cdot10^5$ N/mm$^2$:

$$BS_{min}(z)=1.1\cdot10^5[1.6+0.002378(40-z)^2]^3 \tag{14}$$

$$BS_{max}(z)=1.1\cdot10^5[2.5+0.002854(40-z)^2]^3 \tag{15}$$

$$BS_{nom}(z)=1.1\cdot10^5[2.05+0.002616(40-z)^2]^3 \tag{16}$$

Referring to FIG. 15, the representative bending stiffness profiles obtained using Equations 14-16 are shown. Like the effective range along the head origin x-axis, the effective range along the head origin z-axis begins 10 mm away from the geometric center of the striking face 18 as the portion of the face 18 within the less-effective range 0 mm≤|z|≤10 mm has a relatively small effect on the stiffness of the face. Also shown in FIG. 15 is a bending stiffness profile for an exemplary embodiment of a striking face 18 that is bounded by $BS_{min}$ and $BS_{max}$ along 100% of the effective z-axis range.

Compared to constant thickness faces, the bending stiffness profiles along the x-axis and z-axis represent preferred bending stiffness profiles for increasing the stiffness distribution for a more forgiving face. The same or similar advantages can be achieved, however, by a face having bending stiffness profiles along the x-axis and z-axis that are bounded by the minimum and maximum thickness profiles for the respective x-axis and z-axis along a predetermined portion of the effective range. For example, according to certain implementations, the striking face 18 can have a bending stiffness profile along the origin x-axis that is bounded by the minimum and maximum bending stiffness profiles along at least 50% of the effective x-axis range. Similarly, the striking face 18 can have a bending stiffness profile along the origin z-axis that is bounded by the minimum and maximum bending stiffness profiles along at least 50% of the effective z-axis range. In more specific implementations, the bending stiffness profile of the striking face 18 is bounded by the minimum and maximum bending stiffness profiles along at least 60%, 70%, 80% or 90% of the effective axis range.

As the bending stiffness profiles vary according to the thickness profiles, the face 18 of golf club head 2 has a bending stiffness profile along the x-axis that is bounded by the minimum and maximum bending stiffness profiles also along approximately 71% of the effective x-axis range. Likewise, the bending stiffness profile along the z-axis of face 18 is bounded by the minimum and maximum bending stiffness profiles also along approximately 65% of the effective z-axis range.

As described above, the bending stiffness profiles shown in FIGS. 14 and 15 were obtained for a golf club head having a face made from a specific titanium alloy. However, because any golf club head falling within the preferred bending stiffness profile ranges described above will achieve the same or similar forgiveness characteristics as the tested golf club head, the bending stiffness profiles in FIGS. 14 and 15 also represent preferred bending stiffness profiles for golf club heads having faces made from materials other than the specific titanium alloy and perhaps different thickness profiles. For example, a golf club head having a face made from a material other than the tested titanium alloy, such as, for example, a different titanium alloy, composite material, or combination of both, can achieve the bending stiffness profiles represented in FIGS. 14 and 15, but because of the material composition of the face, may have thickness profiles different than those represented in FIGS. 14 and 15. It is recognized that even though the thickness profiles may be different, a face achieving the bending stiffness profiles described above will provide the same or similar forgiveness characteristics as a golf club head achieving the thickness profiles described above with regard to a titanium face. In certain implementations, the bending stiffness profile of a golf club head face made from a composite material, e.g., graphite epoxy or laminated metals, can be obtained by summation of the thickness of the layers using methods commonly known in lamination theory The crown 12, sole 14, and skirt 16 can be integrally formed using techniques such as molding, cold forming, casting, and/or forging and the striking face 18 can be attached to the crown, sole and skirt by means known in the art. For example, the striking face 18 can be attached to the body 10 as described in U.S. Patent Application Publication Nos. 2005/0239575 and 2004/0235584. The body 10 can be made from a metal alloy (e.g., titanium, steel, aluminum, and/or magnesium), composite material, ceramic material, or any combination thereof. The wall 72 of the golf club head 2 can be made of a thin-walled construction, such as described in U.S. application Ser. No. 11/067,475, filed Feb. 25, 2005, which is incorporated herein by reference. For example, in some implementations, the wall can have a thickness between approximately 0.65 mm and approximately 0.8 mm. In one specific implementation, the wall 72 of the crown 12 and skirt 16 has a thickness of approximately 0.65 mm, and the wall of the sole 14 has a thickness of approximately 0.8 mm.

A club head origin coordinate system may be defined such that the location of various features of the club head (including, e.g., a club head center-of-gravity (CG) 50 (see FIGS. 5 and 6)) can be determined. Referring to FIGS. 4-6, a club head origin 60 is represented on club head 2. The club head origin 60 is positioned at the ideal impact location 23, or geometric center, of the striking surface 22.

Referring to FIGS. 5 and 6, the head origin coordinate system, as defined with respect to the head origin 60, includes three axes: a z-axis 65 extending through the head origin 60 in a generally vertical direction relative to the ground 17 when the club head 2 is at the address position; an x-axis 70 extending through the head origin 60 in a toe-to-heel direction generally parallel to the striking surface 22, i.e., generally tangential to the striking surface 22 at the ideal impact location 23, and generally perpendicular to the z-axis 65; and a y-axis 75 extending through the head origin 60 in a front-to-back direction and generally perpendicular to the x-axis 70 and to the z-axis 65. The x-axis 70 and the y-axis 75 both extend in generally horizontal directions relative to the ground 17 when the club head 2 is at the address position. The x-axis 70 extends in a positive direction from the origin 60 to the heel 26 of the club head 2. The y-axis 75 extends in a positive direction from the origin 60 towards the rear portion 32 of the club head 2. The z-axis 65 extends in a positive direction from the origin 60 towards the crown 12.

In one embodiment, the golf club head can have a CG with an x-axis coordinate between approximately 0.0 mm and approximately 6.0 mm, a y-axis coordinate between approximately 30 mm and approximately 50 mm, and a z-axis coordinate between approximately 0.0 mm and approximately −6.0 mm. Referring to FIGS. 5 and 6, in one specific implementation, the CG x-axis coordinate is approximately 1.8 mm, the CG y-axis coordinate is approximately 37.1 mm, and the CG z-axis coordinate is approximately −3.3 mm.

Referring to FIG. 4, club head 2 has a maximum club head height ($H_{ch}$) defined as the distance between the lowest and highest points on the outer surface of the body 10 measured along an axis parallel to the z-axis when the club head 2 is at proper address position; a maximum club head width ($W_{ch}$) defined as the distance between the maximum extents of the heel and toe portions 26, 28 of the body measured along an axis parallel to the x-axis when the club head 2 is at proper address position; and a maximum club head depth ($D_{ch}$), or length, defined as the distance between the forwardmost and rearwardmost points on the surface of the body 10 measured along an axis parallel to the y-axis when the club head 2 is at proper address position. The height and width of club head 2 is measured according to the USGA "Procedure for Measuring the Clubhead Size of Wood Clubs" Revision 1.0. In some implementations, the golf club head 2 has a height ($H_{ch}$) between approximately 48 mm and approximately 72 mm, a width ($W_{ch}$) between approximately 100 mm and approximately 130 mm, and a depth ($D_{ch}$) between approximately 100 mm and approximately 130 mm. In one specific implementation, the golf club head 2 has a height ($H_{ch}$) of approximately 60.7 mm, width ($W_{ch}$) of approximately 120.5 mm, and depth ($D_{ch}$) of approximately 106.7 mm.

Referring to FIGS. 5 and 6, golf club head moments of inertia are typically defined about three axes extending through the golf club head CG 50: (1) a CG z-axis 85 extending through the CG 50 in a generally vertical direction relative to the ground 17 when the club head 2 is at address position; (2) a CG x-axis 90 extending through the CG 50 in a heel-to-toe direction generally parallel to the striking surface 22 and generally perpendicular to the CG z-axis 85; and (3) a CG y-axis 95 extending through the CG 50 in a front-to-back direction and generally perpendicular to the CG x-axis 90 and the CG z-axis 85. The CG x-axis 90 and the CG y-axis 95 both extend in a generally horizontal direction relative to the ground 17 when the club head 2 is at the address position.

A moment of inertia about the golf club head CG x-axis 90 is calculated by the following equation $$Ixx=\int(y^2+z^2)dm \tag{17}$$

where y is the distance from a golf club head CG xz-plane to an infinitesimal mass dm and z is the distance from a golf club head CG xy-plane to the infinitesimal mass dm. The golf club head CG xz-plane is a plane defined by the golf club head CG x-axis 90 and the golf club head CG z-axis 85. The CG xy-plane is a plane defined by the golf club head CG x-axis 90 and the golf club head CG y-axis 95.

A moment of inertia about the golf club head CG z-axis 85 is calculated by the following equation $$Izz=\int(x^2+y^2)dm \tag{18}$$

where x is the distance from a golf club head CG yz-plane to an infinitesimal mass dm and y is the distance from the golf club head CG xz-plane to the infinitesimal mass dm. The golf club head CG yz-plane is a plane defined by the golf club head CG y-axis 95 and the golf club head CG z-axis 85.

As the moment of inertia about the CG z-axis (Izz) is an indication of the ability of a golf club head to resist twisting about the CG z-axis, the moment of inertia about the CG x-axis (Ixx) is an indication of the ability of the golf club head to resist twisting about the CG x-axis. The higher the moment of inertia about the CG x-axis (Ixx), the greater the forgiveness of the golf club head on high and low off-center impacts with a golf ball. In other words, a golf ball hit by a golf club head on a location of the striking surface 18 above the ideal impact location 23 causes the golf club head to twist upwardly and the golf ball to have a higher trajectory than desired. Similarly, a golf ball hit by a golf club head on a location of the striking surface 18 below the ideal impact location 23 causes the golf club head to twist downwardly and the golf ball to have a lower trajectory than desired. Increasing the moment of inertia about the CG x-axis (Ixx) reduces upward and downward twisting of the golf club head to reduce the negative effects of high and low off-center impacts.

Compared to relatively constant thickness face designs, the variable thickness of the striking face 18 described above facilitates (1) a reduction in the mass, e.g., weight, of the face without exceeding the USGA COR constraints to allow more discretionary weight to be positioned away from the center of gravity for increased moments of inertia or strategically positioned for achieving a desired center of gravity location; (2) an increase in the size of the striking surface to promote forgiveness; and (3) an increase in the size of a club head COR zone, e.g., the sweet spot of the golf club head face that provides the better golf shot forgiveness compared to other portions of the face.

Because of the weight savings resulting from the variable thickness striking face 18, more discretionary weight is available to increase the moments of inertia of the golf club head 2. For example, in some implementations, the moment of inertia about the CG z-axis (Izz) of golf club head 2 is between approximately 490 kg·mm$^2$ and 600 kg·mm$^2$, and the moment of inertia about the CG x-axis (Ixx) of golf club head 2 is between approximately 280 kg·mm$^2$ and approximately 420 kg·mm$^2$. In one specific exemplary implementation, as shown in FIG. 1, the moment of inertia about the CG z-axis (Izz) of golf club head 2 is approximately 528 kg·mm$^2$ and the moment of inertia about the CG x-axis (Ixx) of golf club head 2 is approximately 339 kg·mm$^2$.

As described above, a variable thickness striking face, such as striking face 18, allows the area of the striking face 20 to be increased, while maintaining the durability of the face and keeping the COR of the face within the USGA limitations. The larger the face, the more surface area available to contact a golf ball, and thus the more forgiving the golf club head. A larger striking face is one of the most important features of a golf club, because it is the only part of the club that makes contact with the ball. Providing a larger face minimizes the chance to hit the ball off the edge of the face (resulting in, for example, a "pop up" ball trajectory). Accordingly, a larger striking face gives golfers more confidence to swing more aggressively at the ball.

Variable thickness striking faces, such as striking face 18, increases the COR zone of the face to increase the forgiveness of the golf club head. For example, referring to FIG. 16, the forgiveness of golf club heads having various combinations of constant and variable thickness faces and moments of inertia about a CG z-axis (Izz) is compared. The ballspeed of a golf ball impacted at various locations on the striking surface along the golf club head origin x-axis for each golf club head configuration is shown. Club heads that experience less ball speed reduction for off-center hits are said to promote greater forgiveness. Each golf club head had a COR of 0.820 and a head mass of 206 g and was traveling at 109 mph at impact with the golf ball. These results are based on modeling the club head using the commercially available finite element analysis tool ABAQUS. As shown, the golf club head having an Izz of 600 kg·mm$^2$and constant thickness face has similar forgiveness characteristics as the golf club head having a lower Izz of 400 kg·mm$^2$ but a variable thickness face. Further, the embodiment having an Izz of 600 kg·mm$^2$ and variable thickness face promotes greater forgiveness than the golf club head having a higher Izz of 800 kg·mm$^2$ and constant thickness face.

This is not to say that club heads with a variable thickness face plate and an Izz of 600 kg·mm$^2$ has an actual moment of inertia about the z-axis in excess of 600 kg·mm$^2$. Instead, the "feel" of the club head compares favorably to a golf club head having the higher moment of inertia about the z-axis. It can thus be said that a club head with a variable thickness face plate and an Izz of 600 kg·mm$^2$ has an "effective MOI" in excess of 800 kg·mm$^2$ when considering ball speed resulting from off-center hits. Club heads with actual MOI less than 600 kg·mm$^2$ (e.g., 590 kg·mm$^2$+10 kg·mm$^2$ measurement tolerance) would actually be considered conforming to USGA MOI rules even though the effective MOI (compared to constant face plate thickness designs) appears to be greater than 600 kg·mm$^2$.

Figure 17:
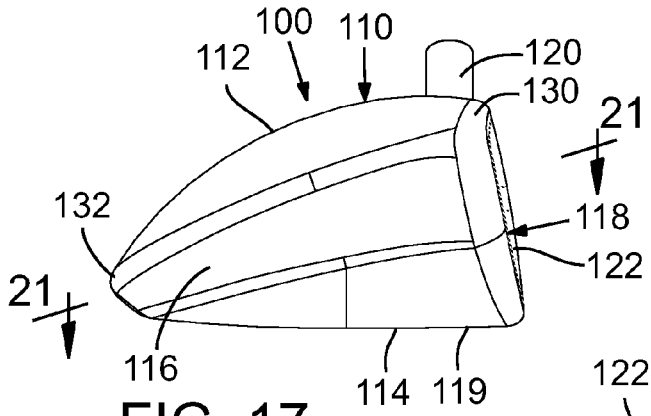
FIG. 17 is a side elevation view of a golf club head according to a second embodiment.

Referring to FIGS. 17-22, and according to another exemplary embodiment, golf club head 100 has a body 110 with a crown 112, sole 114, skirt 116, and striking face 118 defining an interior cavity 157. The body 110 further includes a hosel 120, heel portion 126, a toe portion 128, a front portion 130, a rear portion 132, and an internal rib 182. The striking face 118 includes an outwardly facing ball striking surface 122 having an ideal impact location at a geometric center 123 of the striking surface. In some implementations, the golf club head 100 has a volume between approximately 400 cm$^3$ and approximately 490 cm$^3$, and a total mass between approximately 185 g and approximately 215 g. Referring to FIG. 17, in one specific implementation, the golf club head 100 has a volume of approximately 454 cm$^3$ and a total mass of approximately 202.8 g.

Unless otherwise noted, the general details and features of the body 110 of golf club head 100 can be understood with reference to the same or similar features of the body 10 of golf club head 2.

Figure 22:
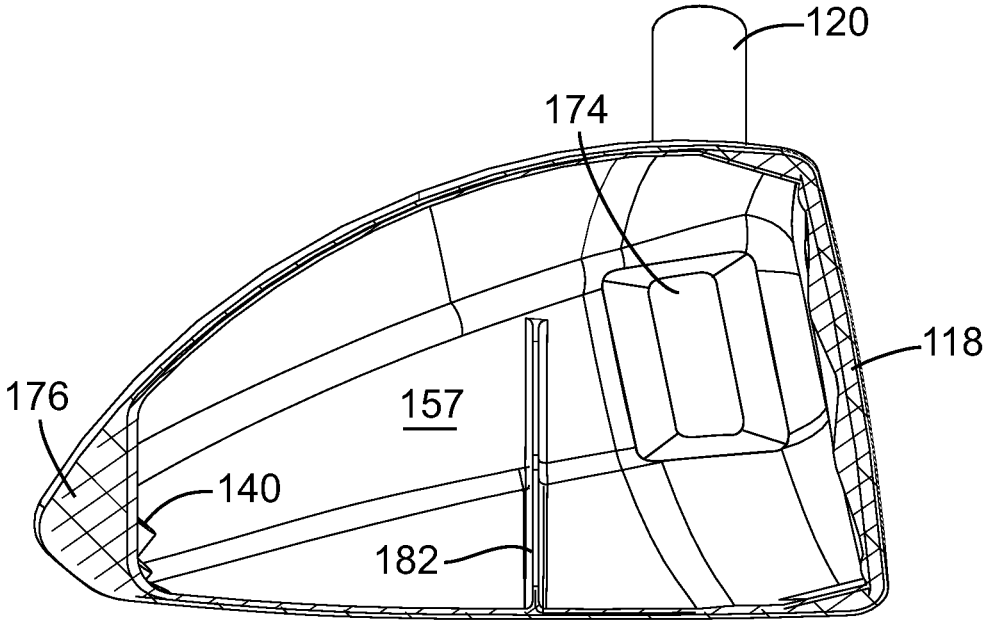
FIG. 22 is a cross-sectional side view of the golf club head of FIG. 17 taken along the line 22-22 of FIG. 20.

In the illustrated implementation, the face 118 of golf club head 100 has a thickness profile along the x-axis (see FIG. 21) and the z-axis (see FIG. 22). The thickness profile along the x-axis of face 118 is bounded by the minimum and maximum thickness profiles along approximately 100% of the effective x-axis range. Similarly, the thickness profile along the z-axis of face 118 is bounded by the minimum and maximum thickness profiles along approximately 100% of the effective z-axis range.

As the bending stiffness profiles vary according to the thickness profiles, the face 118 of golf club head 100 has a bending stiffness profile along the x-axis that is bounded by the minimum and maximum bending stiffness profiles also along approximately 100% of the effective x-axis range. Likewise, the bending stiffness profile along the z-axis of face 118 is bounded by the minimum and maximum bending stiffness profiles also along approximately 100% of the effective z-axis range.

The sole 114 extends upwardly from the lowest point of the golf club head 100 a shorter distance than the sole 14 of golf club head 2. For example, in some implementations, the sole 114 extends upwardly approximately 50% to 60% of the distance from the lowest point of the club head 100 to the crown 112, which in some instances, can be approximately 15 mm for a driver and between approximately 10 mm and approximately 12 mm for a fairway wood. Further, the sole 114 comprises a substantially flat portion 119 extending horizontal to the ground 117 when in proper address position. In some implementations, the bottommost portion of the sole 114 extends substantially parallel to the ground 117 between approximately 5% and approximately 70% of the depth ($D_{ch}$) of the golf club head 100.

Because the sole 114 of golf club head 100 is shorter than the sole 12 of golf club head 2, the skirt 116 is taller, i.e., extends a greater approximately vertical distance, than the skirt 16 of golf club head 2.

In at least one implementation, the golf club head 100 includes a weight port 140 formed in the skirt 116 proximate the rear portion 132 of the club head (see FIG. 12). The weight port 140 can have any of a number of various configurations to receive and retain any of a number of weights or weight assemblies, such as described in U.S. patent application Ser. Nos. 11/066,720 and 11/065,772, which are incorporated herein by reference.

In some implementations, the striking surface 122 golf club head 100 has a height ($H_{ss}$) between approximately 45 mm and approximately 65 mm, and a width ($W_{ss}$) between approximately 75 mm and approximately 105 mm. In one specific implementation, the striking face 122 has a height ($H_{ss}$) of approximately 54.4 mm, width ($W_{ss}$) of approximately 90.6 mm, and total striking surface area of approximately 4,098 mm$^2$.

In one embodiment, the golf club head 100 has a CG with an x-axis coordinate between approximately 0.0 mm and approximately 6.0 mm, a y-axis coordinate between approximately 30 mm and approximately 50 mm, and a z-axis coordinate between approximately 0.0 mm and approximately −6.0 mm. In one specific implementation, the CG x-axis coordinate is approximately 2.0 mm, the CG y-axis coordinate is approximately 37.9 mm, and the CG z-axis coordinate is approximately −4.67 mm.

In some implementations, the golf club head 100 has a height ($H_{ch}$) between approximately 48 mm and approximately 72 mm, a width ($W_{ch}$) between approximately 100 mm and approximately 130 mm, and a depth ($D_{ch}$) between approximately 100 mm and approximately 130 mm. In one specific implementation, the golf club head 100 has a height ($H_{ch}$) of approximately 62.2 mm, width ($W_{ch}$) of approximately 119.3 mm, and depth ($D_{ch}$) of approximately 103.9 mm.

According to certain exemplary embodiments, the golf club head 100 has a moment of inertia about the CG z-axis (Izz) between about 490 kg·mm$^2$ and about 600 kg·mm$^2$, and a moment of inertia about the CG x-axis (Ixx) between about 280 kg·mm$^2$ and about 420 kg·mm$^2$. In one specific implementation, the club head 100 has a moment of inertia about the CG z-axis (Izz) of approximately 500 kg·mm$^2$ and a moment of inertia about the CG x-axis (Ixx) of approximately 337 kg·mm$^2$.

Figure 23:
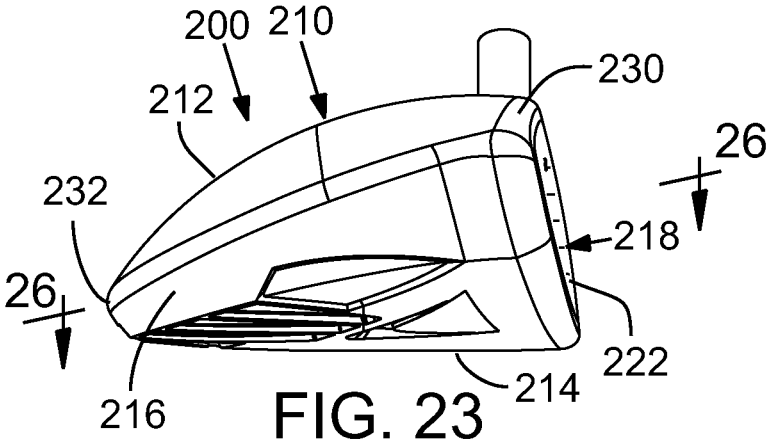
FIG. 23 is a side elevation view of a golf club head according to a third embodiment.
Figure 24:
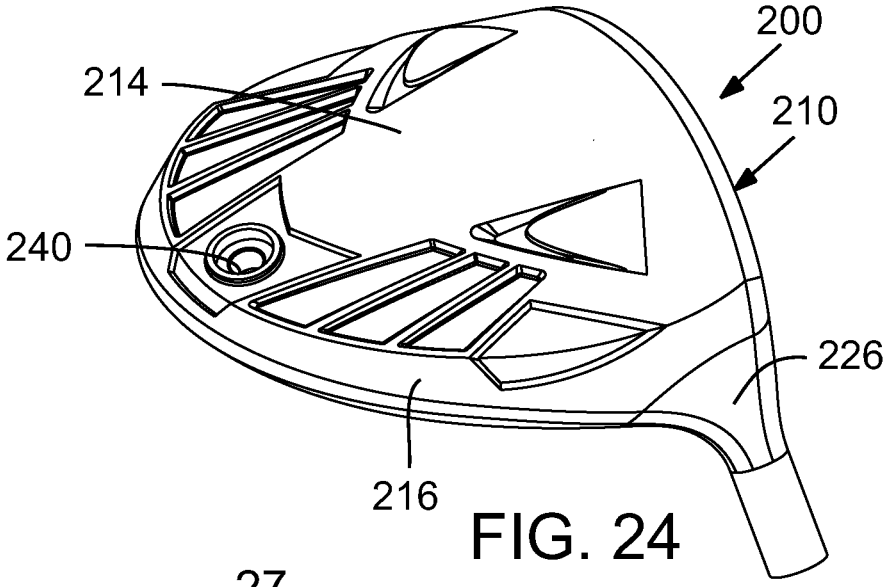
FIG. 24 is a bottom perspective view of the golf club head of FIG. 23.
Figure 25:
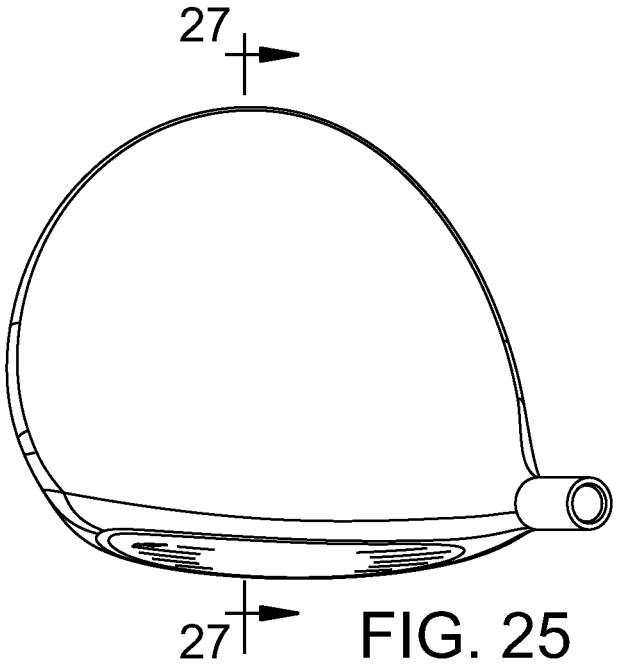
FIG. 25 is a top plan view of the golf club head of FIG. 23.
Figure 26:
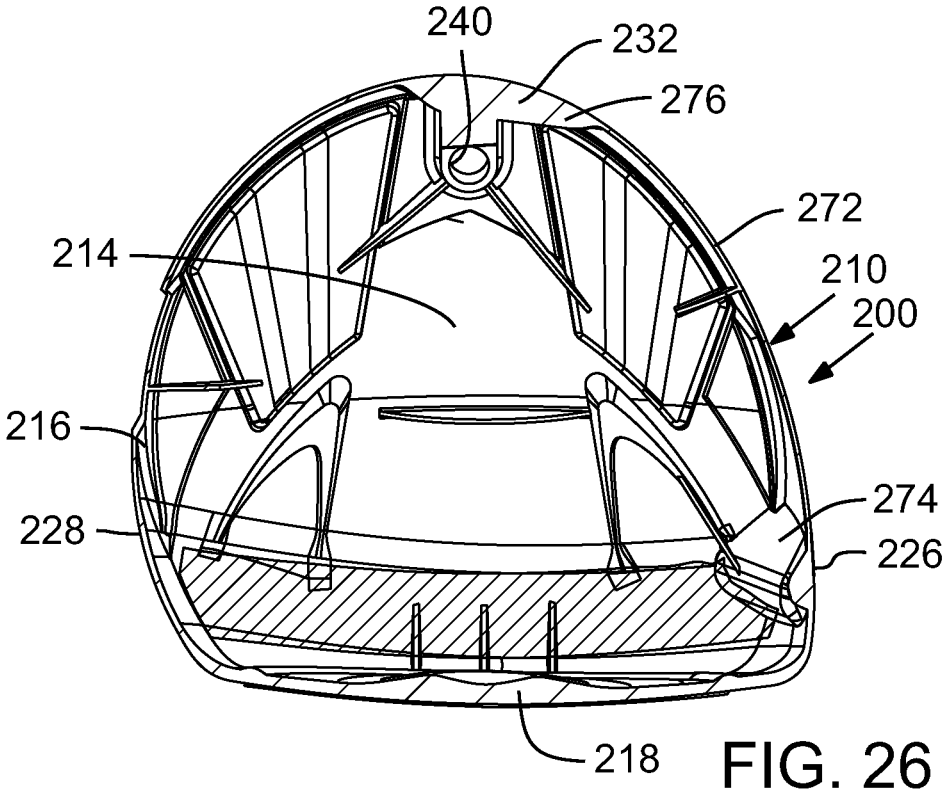
FIG. 26 is a cross-sectional view of the golf club head of FIG. 23 taken along the line 26-26 of FIG. 23.

Referring to FIGS. 23-27, and according to another exemplary embodiment, golf club head 200 has a body 210 with a low skirt similar to body 110 of golf club head 100 and body 10 of golf club head 2. The body 210 includes a crown 212, a sole 214, a skirt 216, a striking face 218 defining an interior cavity 257. The body 210 further includes a hosel 220, heel portion 226, toe portion 228, front portion 230, and rear portion 232. The striking face 218 includes an outwardly facing ball striking surface 222 having an ideal impact location at a geometric center 223 of the striking surface. In some implementations, the golf club head 200 has a volume between approximately 400 cm$^3$ and approximately 490 cm$^3$, and a total mass between approximately 185 g and approximately 215 g. Referring to FIG. 23, in one specific implementation, the golf club head 200 has a volume of approximately 455 cm$^3$ and a total mass of approximately 203.9 g. In other specific implementation, the golf club head 200 has a volume of approximately 444 cm$^3$ and a total mass of approximately 205.2 g Unless otherwise noted, the general details and features of the body 210 of golf club head 200 can be understood with reference to the same or similar features of the body 10 of golf club head 2 and body 110 of golf club head 100.

Figure 27:
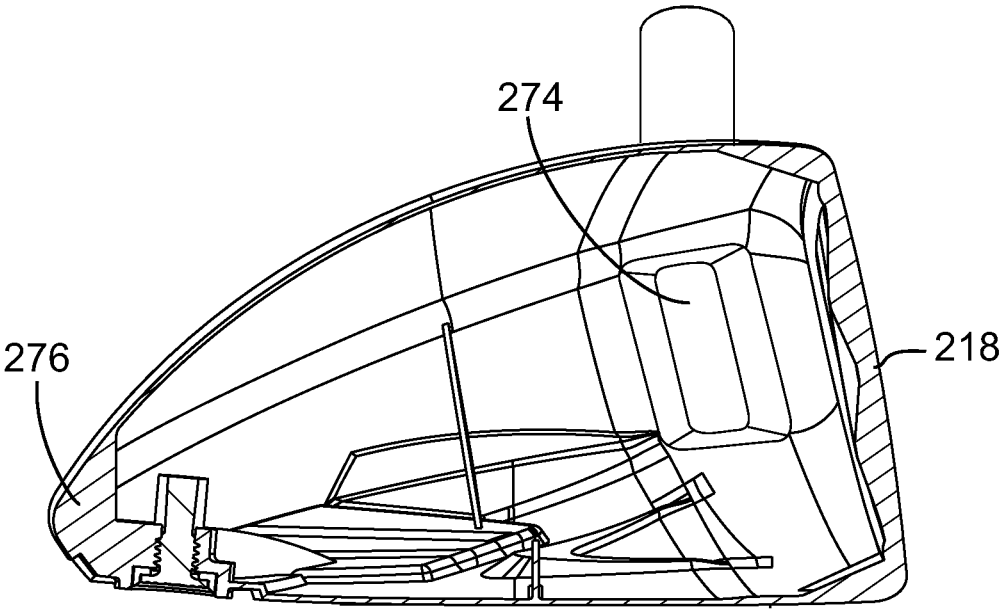
FIG. 27 is a cross-sectional side view of the golf club head of FIG. 23 taken along the line 27-27 of FIG. 25.

In the illustrated implementation, the face 218 of golf club head 200 has a thickness profile along the x-axis (see FIG. 26) and the z-axis (see FIG. 27). The thickness profile along the x-axis of face 18 is bounded by the minimum and maximum thickness profiles along approximately 100% of the effective x-axis range. Similarly, the thickness profile along the z-axis of face 218 is bounded by the minimum and maximum thickness profiles along approximately 100% of the effective z-axis range.

As the bending stiffness profiles vary according to the thickness profiles, the face 218 of golf club head 200 has a bending stiffness profile along the x-axis that is bounded by the minimum and maximum bending stiffness profiles also along approximately 100% of the effective x-axis range. Likewise, the bending stiffness profile along the z-axis of face 218 is bounded by the minimum and maximum bending stiffness profiles also along approximately 100% of the effective z-axis range.

Like sole 114 of golf club head 100, the sole 214 extends upwardly approximately 50% to 60% of the distance from the lowest point of the club head 200 to the crown 212. Therefore, the skirt 216 is taller, i.e., extends a greater approximately vertical distance, than the skirt 16 of golf club head 2.

Figure 16:
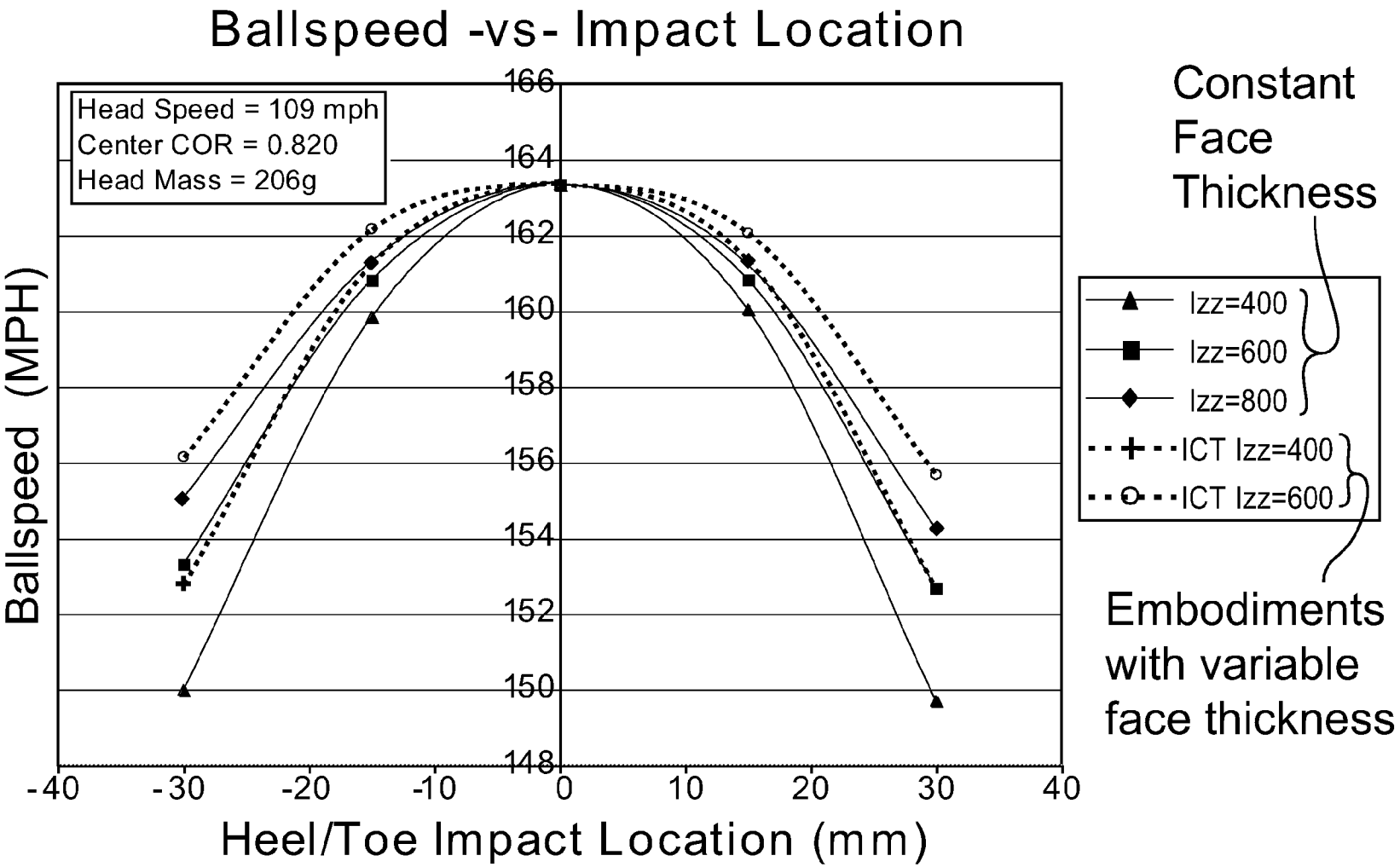
FIG. 16 is a plot of variation in ball speed loss according to striking face impact location for different golf club head embodiments.
Figure 18:
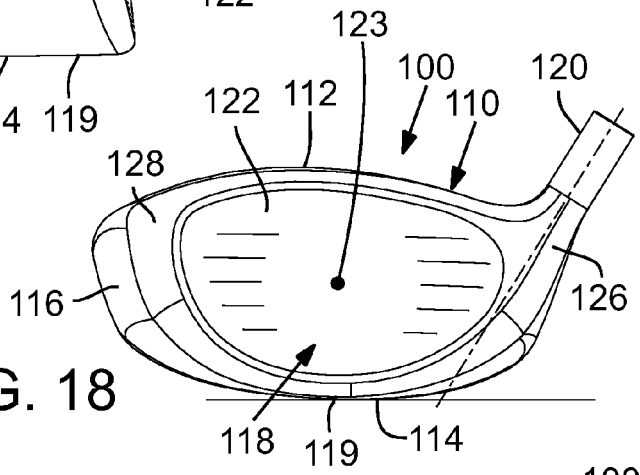
FIG. 18 is a front elevation view of the golf club head of FIG. 17.
Figure 19:
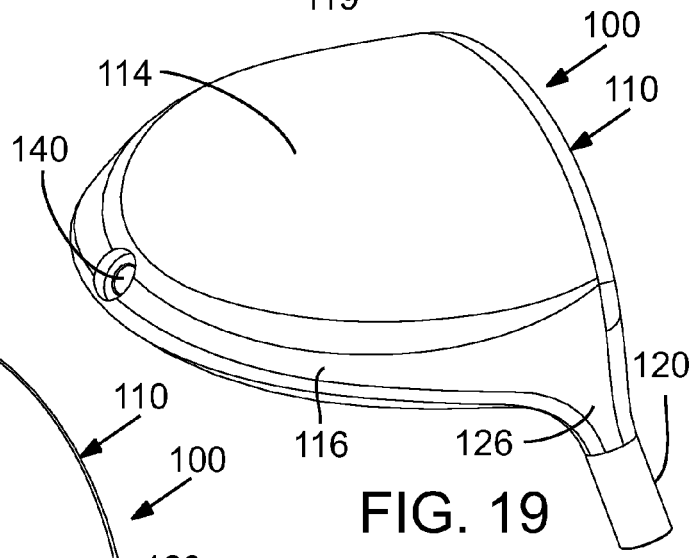
FIG. 19 is a bottom perspective view of the golf club head of FIG. 17.
Figure 20:
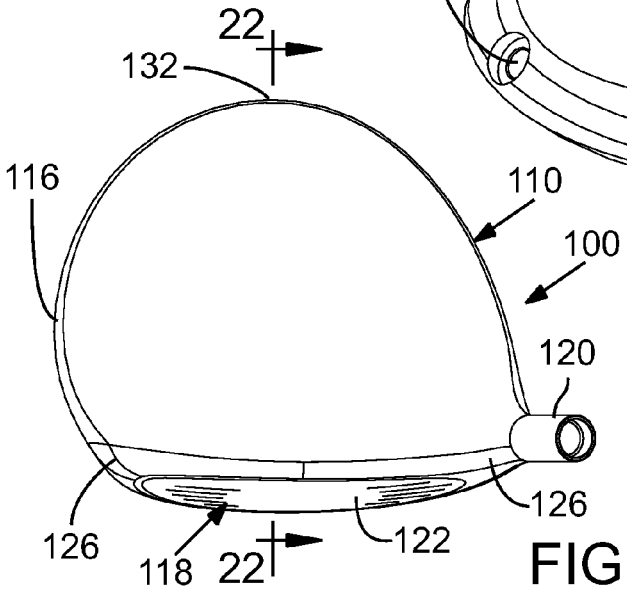
FIG. 20 is a top plan view of the golf club head of FIG. 17.
Figure 21:
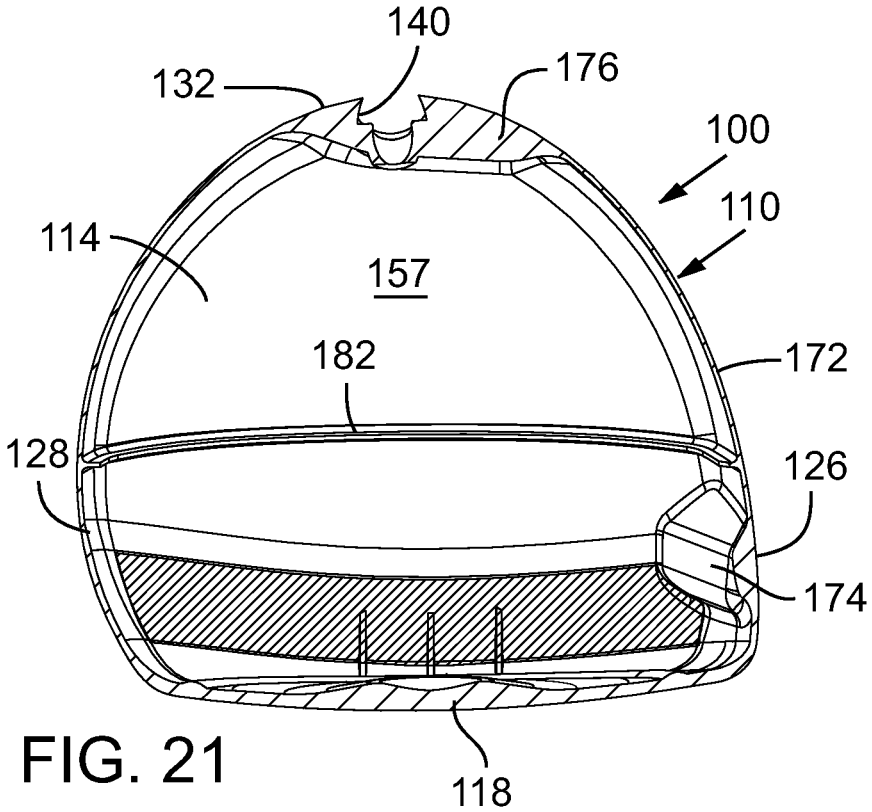
FIG. 21 is a cross-sectional view of the golf club head of FIG. 17 taken along the line 21-21 of FIG. 17.

In at least one implementation, and shown in FIGS. 16, 18 and 20, the golf club head 200 includes a weight port 240 formed in the sole 114 proximate the rear portion 232 of the club head. The weight port 240 can have any of a number of various configurations to receive and retain any of a number of weights or weight assemblies. For example, as shown, the weight port 240 extends substantially vertically from the wall 272 of the body 210 upwardly into the interior cavity 257.

In some implementations, the striking surface 222 golf club head 200 has a height ($H_{ss}$) between approximately 45 mm and approximately 65 mm, and a width ($W_{ss}$) between approximately 75 mm and approximately 105 mm. In one specific implementation, the striking surface 222 has a height ($H_{ss}$) of approximately 53.5 mm, width ($W_{ss}$) of approximately 92.3 mm, and total striking surface area of approximately 4,013 mm$^2$. In another specific implementation, the striking surface 222 has a height ($H_{SS}$) of approximately 54.7 mm, width ($W_{ss}$) of approximately 92.3 mm, and total striking surface area of approximately 4,115 mm$^2$.

In one embodiment, the golf club head 200 has a CG with an x-axis coordinate between approximately 0.0 mm and approximately 6.0 mm, a y-axis coordinate between approximately 30 mm and approximately 50 mm, and a z-axis coordinate between approximately 0.0 mm and approximately −6.0 mm. In one specific implementation, the CG x-axis coordinate is approximately 2.2 mm, the CG y-axis coordinate is approximately 37.9 mm, and the CG z-axis coordinate is approximately −4.3 mm. In another specific implementation, the CG x-axis coordinate is approximately 2.8 mm, the CG y-axis coordinate is approximately 35.8 mm, and the CG z-axis coordinate is approximately −3.4 mm.

In some implementations, the golf club head 200 has a height ($H_{ch}$) between approximately 48 mm and approximately 72 mm, a width ($W_{ch}$) between approximately 100 mm and approximately 130 mm, and a depth ($D_{ch}$) between approximately 100 mm and approximately 130 mm. In one specific implementation, the golf club head 200 has a height ($H_{ch}$) of approximately 62.3 mm, width ($W_{ch}$) of approximately 120.0 mm, and depth ($D_{ch}$) of approximately 111.6 mm. In another specific implementation, the golf club head 200 has a height ($H_{ch}$) of approximately 62.6 mm, width ($W_{ch}$) of approximately 121.0 mm, and depth ($D_{ch}$) of approximately 107.4 mm.

The golf club head 200 can, in some implementations, have a moment of inertia about the CG z-axis (Izz) between about 490 kg·mm$^2$ and about 600 kg·mm$^2$, and a moment of inertia about the CG x-axis (Ixx) between about 280 kg·mm$^2$ and about 420 kg·mm$^2$. In one specific implementation, the club head 200 has a moment of inertia about the CG z-axis (Izz) of approximately 516 kg·mm$^2$ and a moment of inertia about the CG x-axis (Ixx) of approximately 354 kg·mm$^2$. In another specific implementation, the club head 200 has a moment of inertia about the CG z-axis (Izz) of approximately 496 kg·mm$^2$ and a moment of inertia about the CG x-axis (Ixx) of approximately 329 kg·mm$^2$.

Figure 28A:
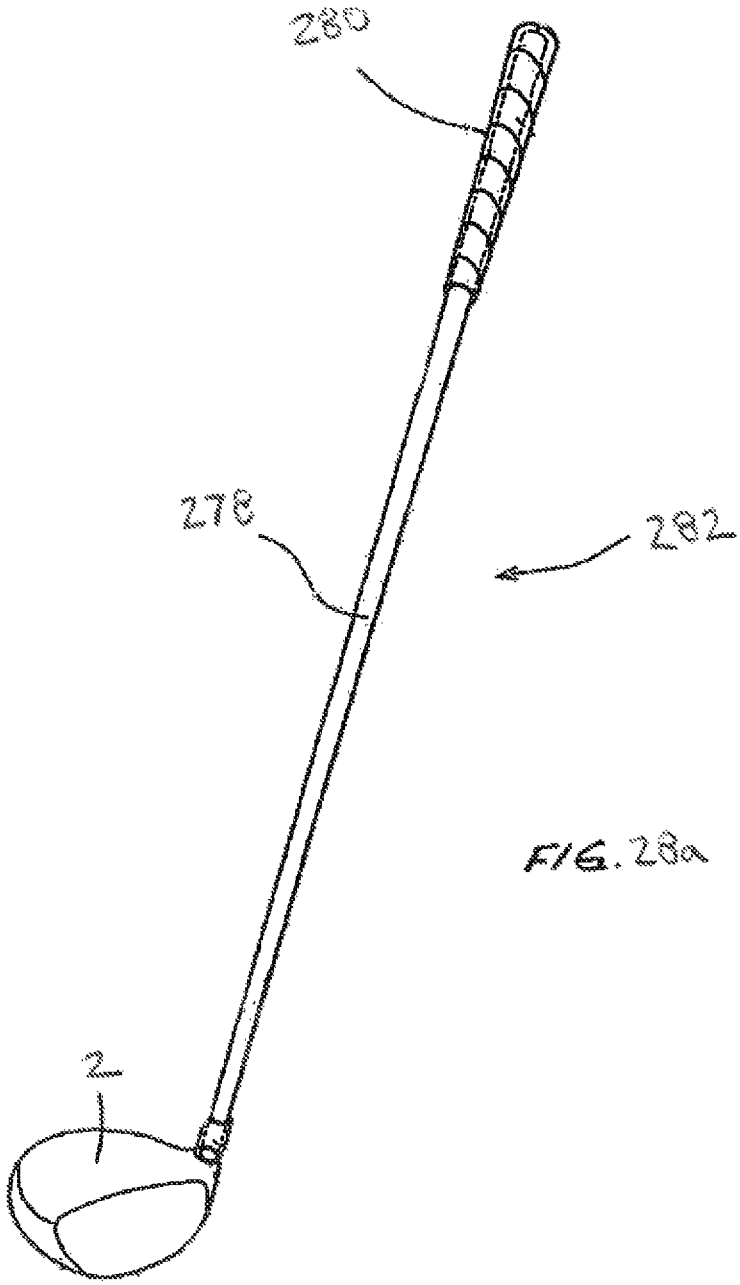
FIG. 28*a* is a side elevation view of a golf club according to an embodiment.
Figure 28B:
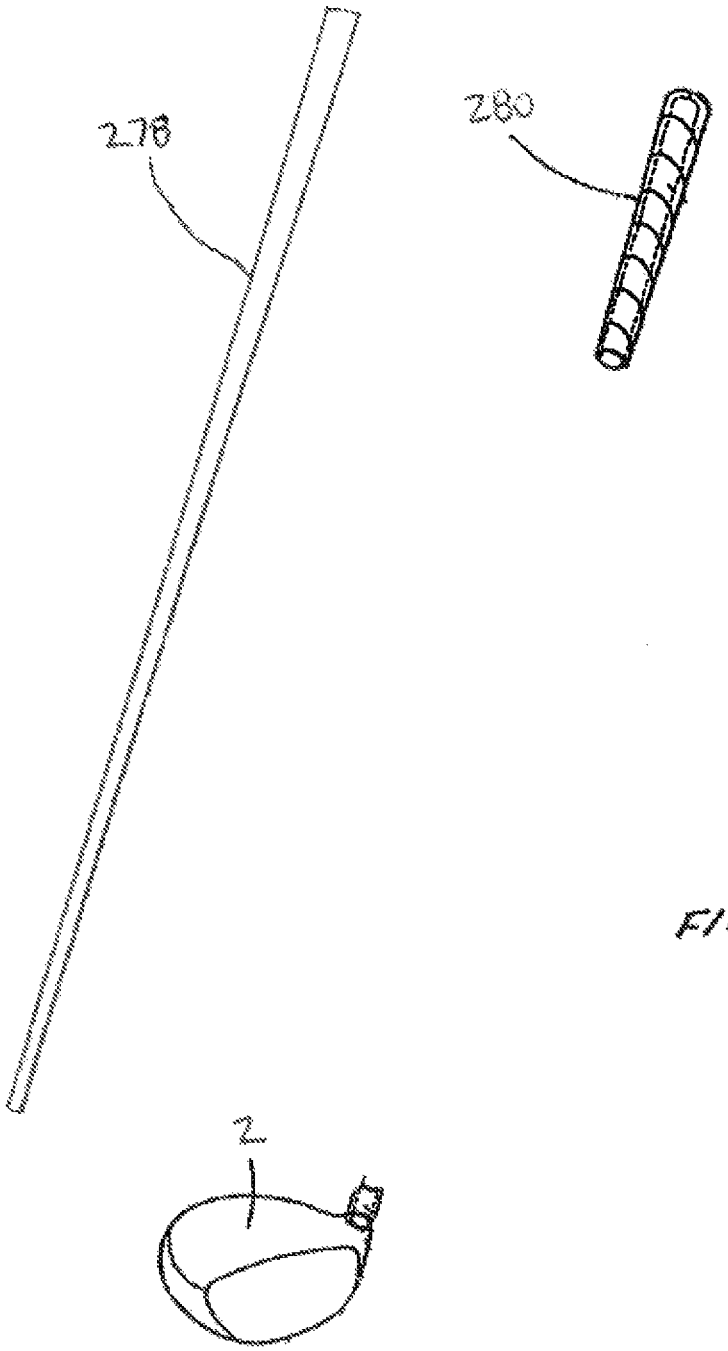
FIG. 28*b* is an exploded view of a golf club according to an embodiment.

Referring to FIGS. 28*a* and 28*b*, another exemplary embodiment is illustrated. Illustrated in FIG. 28*a* is an assembled golf club 282, which may incorporate one or more of the golf club heads described previously. The golf club head 2 may include a shaft 278, and a grip 280. An exploded view of golf club head 282 is illustrated in FIG. 28*b*. The golf club shaft 278 may, when assembled with golf club head 2 and grip 280, comprise a golf club having a particular club length. In this embodiment, the club length may be greater than about 46 inches, preferably between about 46 inches and 48 inches, and more preferably between about 46 inches and 47 inches. It should be noted that the shaft 278 may be a different length than the club length, as the club length is defined as the measure of length of a club set on a horizontal plane with the sole set against a 60 degree plane, with the length being the intersection between these two planes and the top of the grip. See USGA "Procedure for Measuring the Length of Golf Clubs," revision 1.1. An increased club length may provide an increased club head speed at ball impact, such as by increasing the moment arm of the club when swung, for example. However, a longer club length may result in an increased difficulty in hitting at the center of the golf club face. In one embodiment, a golf club 282 having an increased club length may incorporate a golf club head 2 having an increased moment of inertia, larger face and/or a particular center of gravity location, such as in one or more of the previously described embodiments. This may result in a golf club that provides a golfer with the ability to achieve a desired or increased performance despite hitting at other than an ideal face location, by minimizing the effect of a mis-hit while increasing the club head speed at ball impact.

The club head grip 280 may comprise a reduced weight grip as compared to a typical grip. For example, the grip 280 may have a total mass between about 15 grams and about 50 grams. In this embodiment, the golf club grip may preferably have a total mass less than about 40 grams, or more preferably less than about 30 grams. Similarly, the shaft 278 may have a reduced weight as compared to a typical shaft. In this embodiment, the shaft 278 may have a total mass than about 60 grams, preferably less than about 50 grams and more preferably less than about 45 grams. As noted previously, the golf club head may have a total mass between about 185 grams and 215 grams. When assembled, golf club 282 may have a reduced weight as compared to a typical club, and may have a total mass between about 245 grams and about 300 grams, and more preferably between about 270 grams and about 300 grams. This weight may be less than a weight of a club of equal club length or less than or equal to a weight of a club of lesser club length.

The shaft 278 may be formed from one or more materials or combinations of materials, such as carbon fiber or epoxy, as just a few examples. The shaft 278 may have a relatively low fiber areal weight, such as a fiber areal weight less than about 75 g/mm$^2$ if the shaft is formed from carbon fiber, for example. Furthermore, the resin content may be relatively low, such as less than about 33%, if the shaft 278 incorporates resin. The grip 280 may be formed from one or more materials or combinations of materials, such as low density foam, polyurethane and/or rubber, for example. As noted previously, this may result in a relatively light weight shaft and grip, which, in combination with a golf club head may result in a golf club having a relatively low weight.

The above golf club illustrated in FIGS. 28*a* and 28*b* demonstrates a preferred embodiment of a golf club utilizing at least one of the golf club head embodiments described earlier. Combining a reduced weight yet longer length shaft with a reduced weight grip will result in a golf club that may produce a higher head speed during a swing. As noted previously, an increased head speed may result in the tendency to mis-hit, or not hit at center face. However, incorporating a club head with a larger face, higher MOI and/or increased forgiveness, such as in one or more of the previously-described embodiments, will result in countering the effects of a hit that is not at an ideal center face location, and may result in a golf club that has a desired performance. Furthermore, if a club head as described herein does result in an impact at the ideal striking face location, the increased head speed resulting from the use of a longer and lighter shaft and lighter grip will result in an increased distance of a golf ball as compared to typical clubs.

In view of the many possible embodiments to which the principles of the disclosed golf club head may be applied, it should be recognized that the illustrated embodiments are only preferred examples of the golf club head and should not be taken as limiting the scope of the golf club head. Rather, the scope of the invention is defined by the following claims. We therefore claim as our invention all that comes within the scope and spirit of these claims.

We claim:

1. A golf club, comprising:

a golf club shaft;

a golf club grip; and a golf club head, the golf club head comprising a body defining an interior cavity and comprising a sole positioned at a bottom portion of the golf club head, a crown positioned at a top portion, and a skirt positioned around a periphery between the sole and crown, wherein the body has a forward portion and a rearward portion; and a face positioned at the forward portion of the body, the face defining a striking surface having an ideal impact location at a golf club head origin, the head origin including an x-axis tangential to the face and generally parallel to the ground when the head is at a proper address position, a y-axis generally perpendicular to the x-axis and generally parallel to the ground when the head is at a proper address position, and a z-axis perpendicular to both the x-axis and y-axis, the striking surface having a striking surface height between approximately 45 mm and approximately 65 mm, and a striking surface width between approximately 75 mm and approximately 105 mm;

wherein the golf club head has a moment of inertia about a golf club head center of gravity z-axis generally parallel to the head origin z-axis greater than approximately 490 kg·mm$^2$, wherein the face has a thickness along the head origin x-axis, the thickness being between $t_{min}$ and $t_{max}$ for at least 50% of the x-axis coordinates x within a first range between approximately −10 mm and approximately −50 mm, and a second range between approximately 10 mm and approximately 50 mm, where $$t_{min}=1.6+0.002378\,(40-|x|)^2, \text{ and} \quad (1)$$

$$t_{max}=2.5+0.002854\,(40-|x|)^2, \quad (2)$$

wherein the thickness at each coordinate of −10 mm and 10 mm along the x-axis is no less than 3.74 mm; and wherein the thickness at each coordinate of −40 mm and 40 mm along the x-axis is no greater than 2.5 mm;

wherein the striking surface has an area greater than about 3,500 mm$^2$, wherein the golf club has a club length between about 46 inches and 48 inches, and wherein the golf club has total mass between about 270 grams and about 300 grams.

2. The golf club of claim 1, wherein the striking surface has an area greater than 3,500 mm$^2$ and less than about 4,500 mm$^2$.

3. The golf club of claim 1, wherein the face has a thickness along the head origin z-axis, the thickness being between $t_{min}$ and $t_{max}$ for at least 50% of the z-axis coordinates z within a third range between approximately −10 mm and approximately −30mm, and a fourth range between approximately 10 mm and approximately 30 mm, where $$t_{min}=1.6+0.002378(40-|z|)^2, \text{ and} \quad (1)$$

$$t_{max}=2.5+0.002854(40-|z|)^2. \quad (2)$$

4. The golf club of claim 1, wherein the thickness of a first portion of the face within at respective one of the first and second ranges is at least approximately 2 mm greater than a second portion of the face within the respective one of the first and second ranges.

5. The golf club of claim 1, wherein the golf club has a total mass greater than about 280 grams and less than about 290 grams.

6. The golf club of claim 5, wherein the golf club grip has a total mass less than about 30 grams.

7. The golf club of claim 1, wherein the golf club grip has a total mass less than about 40 grams.

8. A golf club, comprising:

a golf club shaft;

a golf club grip; and a golf club head, the golf club head comprising a body defining an interior cavity and comprising a sole positioned at a bottom portion of the golf club head, a crown positioned at a top portion, and a skirt positioned around a periphery between the sole and crown, wherein the body has a forward portion and a rearward portion; and a face positioned at the forward portion of the body, the face defining a striking surface having an ideal impact location at a golf club head origin, the head origin including an x-axis tangential to the face and generally parallel to the ground when the head is at a proper address position, a y-axis generally perpendicular to the x-axis and generally parallel to the ground when the head is at a proper address position, and a z-axis perpendicular to both the x-axis and y-axis, the striking surface having a striking surface height between approximately 45 mm and approximately 65 mm, and a striking surface width between approximately 75mm and approximately 105 mm;

wherein the golf club head has a moment of inertia about a golf club head center of gravity x-axis generally parallel to the head origin x-axis greater than approximately 280 kg·mm$^2$, and wherein the face has a thickness along the head origin z-axis, the thickness being between $t_{min}$ and $t_{max}$ for at least 50% of the z-axis coordinates z within a first range between approximately −10 mm and approximately −30 mm, and a second range between approximately 10 mm and approximately 30 mm, where $$t_{min}=1.6+0.002378(40-|z|)^2, \text{ and} \quad (1)$$

$$t_{max}=2.5+0.002854(40-|z|)^2, \quad (2)$$

wherein the thickness at each coordinate of −10 mm and 10 mm along the z-axis is no less than 3.74 mm; and wherein the thickness at each coordinate of −40 mm and 40 mm along the z-axis is no greater than 2.5 mm;

wherein the striking surface has an area greater than about 3,500 mm$^2$, wherein the golf club has a club length between about 46 inches and 48 inches, and wherein the golf club has total mass between about 270 grams and about 300 grams.

9. The golf club of claim 8, wherein the striking surface has an area greater than 3,500 mm$^2$ and less than about 4,500 mm$^2$.

10. The golf club of claim 8, wherein the face has a thickness along the head origin x-axis, the thickness being between $t_{min}$ and $t_{max}$ for at least 50% of the x-axis coordinates x within a third range between approximately −10 mm and approximately −50mm, and a fourth range between approximately 10 mm and approximately 50 mm, where $$t_{min}=1.6+0.002378(40-|x|)^2, \text{ and} \quad (1)$$

$$t_{max}=2.5+0.002854(40-|x|)^2 \quad (2).$$

11. The golf club of claim 8, wherein the thickness of a first portion of the face within at respective one of the first and second ranges is at least approximately 2 mm greater than a second portion of the face within the respective one of the first and second ranges.

12. The golf club of claim 8, wherein the golf club has a total mass greater than about 280 grams and less than about 290 grams.

13. The golf club of claim 12, wherein the golf club grip has a total mass less than about 30 grams.

14. The golf club of claim 8, wherein the golf club grip has a total mass less than about 40 grams.

15. A golf club, comprising:

a golf club shaft;

a golf club grip; and a golf club head, the golf club head comprising a body defining an interior cavity and comprising a sole positioned at a bottom portion of the golf club head, a crown positioned at a top portion, and a skirt positioned around a periphery between the sole and crown, wherein the body has a forward portion and a rearward portion; and a face positioned at the forward portion of the body, the face defining a striking surface having an ideal impact location at a golf club head origin, the head origin including an x-axis tangential to the face and generally parallel to the ground when the head is at a proper address position, a y-axis generally perpendicular to the x-axis and generally parallel to the ground when the head is at a proper address position, and a z-axis perpendicular to both the x-axis and y-axis, the striking surface having a striking surface width between approximately 75 mm and approximately 105 mm;

wherein the golf club head has a moment of inertia about a golf club head center of gravity z-axis generally parallel to the head origin z-axis greater than approximately 490 kg·mm$^2$, and a moment of inertia about a golf club head center of gravity x-axis generally parallel to the head origin x-axis greater than approximately 280 kg·mm$^2$, and wherein the face has a thickness along a radial axis extending tangential to and radially outwardly away from the golf club head origin, the thickness being between $t_{min}$ and $t_{max}$ along at least 50% of the distances r away from the golf club head origin along the radial axis equal to or greater than approximately 10 mm and equal to or less than approximately 50 mm, where $$t_{min}=1.6+0.002378\ (40-r)^2, \text{ and} \quad (1)$$

$$t_{max}=2.5+0.002854\ (40-r)^2, \quad (2)$$

wherein the thickness at each coordinate of −10 mm and 10 mm along the distance r is no less than 3.74 mm; and wherein the thickness at each coordinate of −40 mm and 40 mm along the distance r is no greater than 2.5 mm;

wherein the striking surface has an area greater than about 3,500 $mm^2$, wherein the golf club has a club length between about 46 inches and 48 inches, and wherein the golf club has total mass between about 270 grams and about 300 grams.

16. The golf club of claim 15, wherein the striking surface has an area greater than 3,500 $mm^2$ and less than about 4,500 $mm^2$.

17. The golf club of claim 15, wherein the golf club head has a center of gravity with an x-axis coordinate between approximately 0.0 mm and approximately 6.0 mm, and a z-axis coordinate between approximately 0.0 mm and approximately −6.0 mm.

* * * * *